US011933285B2

(12) United States Patent
Allard et al.

(10) Patent No.: US 11,933,285 B2
(45) Date of Patent: Mar. 19, 2024

(54) DAMPED MOBILE COMPRESSOR

(71) Applicant: Dometic Sweden AB, Solna (SE)

(72) Inventors: James E. Allard, Davisburg, MI (US); Mark L. Smith, Buchanan, MI (US); Peng Wang, JinWan (CN)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 17/049,731

(22) PCT Filed: Apr. 19, 2019

(86) PCT No.: PCT/IB2019/053280
§ 371 (c)(1),
(2) Date: Oct. 22, 2020

(87) PCT Pub. No.: WO2019/207451
PCT Pub. Date: Oct. 31, 2019

(65) Prior Publication Data

US 2021/0239105 A1 Aug. 5, 2021

Related U.S. Application Data

(60) Provisional application No. 62/661,468, filed on Apr. 23, 2018.

(51) Int. Cl.

| | |
|---|---|
| ***F04B 39/12*** | (2006.01) |
| ***F04B 39/00*** | (2006.01) |
| ***F25B 31/02*** | (2006.01) |

(52) U.S. Cl.
CPC ..... *F04B 39/12* (2013.01); *F04B 39/0044* (2013.01); *F25B 31/023* (2013.01); *F25B 2500/13* (2013.01)

(58) Field of Classification Search
CPC . F04B 39/0044; F25B 31/023; F25B 2500/13
See application file for complete search history.

(56) References Cited

U.S. PATENT DOCUMENTS 2,178,811 A * 11/1939 Sateren ..... F25B 31/023 417/372
2,233,102 A * 2/1941 Kucher ..... F25D 23/006 248/613

(Continued)

FOREIGN PATENT DOCUMENTS

AU 2004202967 A1 6/2005
AU 2007200788 A1 9/2007

(Continued)

OTHER PUBLICATIONS

Machine Translation of CN-1657775-A; 2005.*

(Continued)

*Primary Examiner* — Christopher S Bobish
(74) *Attorney, Agent, or Firm* — Dinsmore & Shohl LLP

(57) ABSTRACT

A damped compressor used in mobile appliances. The appliances may comprise a compressor which is disposed within a housing and is in fluid communication with a refrigerant system. Within the housing there is an improved damping or stabilizer system which limits movement of electric or mechanical portions, or both, of the compressor within the housing. At startup and shutdown, when oscillations of the components within the housing are generally maximized, the components are limited from contacting the housing internal structure so as to inhibit damage to the compressor and reduce the noise associated with such contact. The components are also damped from movement associated with the mobile application of the compressor.

22 Claims, 20 Drawing Sheets

(56) References Cited

U.S. PATENT DOCUMENTS 2,723,538 A * 11/1955 Heidorn ..... F25D 23/006 62/295
2,870,614 A 1/1959 Renner et al.
2,930,556 A * 3/1960 Horlacher ..... F25D 23/006 267/152
2,977,043 A 3/1961 Scheldorf
3,220,212 A 11/1965 Fordsmand
3,246,836 A 4/1966 Ayling
3,250,461 A * 5/1966 Parker ..... F25B 31/023 324/76.47
3,292,884 A 12/1966 Scheldorf
3,300,125 A 1/1967 Winkler
3,396,908 A * 8/1968 Vind ..... F04B 39/127 417/363
3,444,854 A 5/1969 Fraim
3,493,168 A * 2/1970 Valbjorn ..... F25B 31/023 417/415
3,672,349 A 6/1972 Derringer
3,685,577 A 8/1972 Goodgion et al.
D226,381 S 2/1973 Harty, Jr.
3,719,058 A 3/1973 Waygood
3,724,442 A 4/1973 Gurney et al.
3,727,537 A 4/1973 Harty, Jr.
3,777,506 A 12/1973 Hergatt et al.
3,836,290 A 9/1974 Carter
3,855,814 A 12/1974 Eubank
3,857,652 A 12/1974 Thayer
3,865,182 A 2/1975 Blossom
3,887,304 A * 6/1975 Otaki ..... F04B 39/0044 415/119
3,896,634 A 7/1975 Nagele et al.
3,906,740 A 9/1975 Thomas
3,973,939 A 8/1976 Abbott
3,984,224 A 10/1976 Dawkins
3,996,762 A 12/1976 Calme et al.
4,045,074 A 8/1977 Howard
4,143,902 A 3/1979 Johnstone
4,192,542 A 3/1980 Hill
4,213,309 A 7/1980 Pifer
4,217,764 A 8/1980 Armbruster
4,567,734 A 2/1986 Dankowski
D284,025 S 5/1986 Armstrong
4,622,831 A 11/1986 Grupa
4,628,702 A 12/1986 Boxum
4,641,502 A 2/1987 Aldrich et al.
4,662,350 A 5/1987 Mossbach
4,672,818 A 6/1987 Roth
4,674,294 A 6/1987 Agaro
4,699,207 A 10/1987 Hanemaayer
4,709,623 A 12/1987 Roth et al.
4,710,610 A 12/1987 Reifel et al.
4,748,825 A 6/1988 King
4,784,214 A 11/1988 Penson et al.
4,787,210 A 11/1988 Brown
4,788,487 A 11/1988 Picklesimer
D300,777 S 4/1989 Bales et al.
4,888,959 A 12/1989 Brown
D306,341 S 2/1990 Bales et al.
4,914,929 A 4/1990 Shimazaki
4,926,655 A 5/1990 King
4,947,657 A 8/1990 Kalmbach
5,001,905 A 3/1991 Miyazaki
5,046,327 A 9/1991 Walker et al.
5,054,378 A 10/1991 Speece
5,095,716 A 3/1992 You
5,123,258 A 6/1992 Brown et al.
5,205,130 A 4/1993 Pannell
5,246,196 A 9/1993 Rollett
5,265,668 A 11/1993 Fisher
5,307,645 A 5/1994 Pannell
5,531,641 A 7/1996 Aldrich
5,533,357 A 7/1996 Voorhis
5,544,929 A 8/1996 Nagai
5,588,301 A 12/1996 Deroche, Sr.
D386,735 S 11/1997 Krueger et al.
5,727,998 A 3/1998 Krueger et al.
D395,704 S 6/1998 Thomas et al.
D396,097 S 7/1998 Thomas et al.
5,848,536 A 12/1998 Dodge et al.
5,878,592 A 3/1999 Borges et al.
5,899,081 A 5/1999 Evans et al.
5,927,090 A 7/1999 Ladendorf et al.
5,960,157 A 9/1999 McGraw
6,029,464 A 2/2000 Kil et al.
6,076,363 A 6/2000 Morton
6,116,037 A 9/2000 Burnett
6,116,095 A 9/2000 Radle
6,132,183 A * 10/2000 Li ..... F04C 29/066 417/363
6,134,909 A 10/2000 Lyu
6,149,513 A 11/2000 Lyu
6,161,609 A 12/2000 Ahn
6,196,914 B1 3/2001 Lyu
6,213,197 B1 4/2001 Ebbeson
6,257,013 B1 7/2001 Murray et al.
6,263,689 B1 7/2001 Dodge et al.
6,276,166 B1 8/2001 Sarkisian et al.
6,282,919 B1 9/2001 Rockenfeller et al.
6,302,780 B1 10/2001 Ahn et al.
6,357,248 B1 3/2002 Bongaards et al.
6,357,249 B1 3/2002 Robinson et al.
6,449,973 B2 9/2002 Dodge et al.
6,494,052 B1 12/2002 Lee
6,536,222 B1 3/2003 Ahn et al.
6,832,899 B2 * 12/2004 Puff ..... F04B 39/127 417/363
D502,255 S 2/2005 Kim
6,857,953 B2 2/2005 Malott
6,925,826 B2 8/2005 Hille et al.
6,971,246 B2 12/2005 Kurata et al.
7,020,386 B2 3/2006 Scime et al.
7,036,332 B2 5/2006 Hallin et al.
7,047,760 B1 5/2006 Holman, Jr.
7,059,137 B2 6/2006 Childress
7,140,192 B2 11/2006 Allen et al.
7,171,822 B2 2/2007 Allen et al.
7,181,918 B2 2/2007 Reinders
D544,589 S 6/2007 Yoo et al.
7,234,315 B2 6/2007 Allen et al.
7,237,397 B2 7/2007 Allen
D549,311 S 8/2007 Yoo et al.
D551,744 S 9/2007 Yoo et al.
D556,314 S 11/2007 Daniels, II et al.
D558,865 S 1/2008 Yoo et al.
D560,787 S 1/2008 Yoo et al.
7,316,119 B2 1/2008 Allen
7,419,368 B2 9/2008 Milks
D588,479 S 3/2009 Giese
7,739,882 B2 6/2010 Evans et al.
D619,236 S 7/2010 Schlag et al.
7,887,306 B2 * 2/2011 Lee ..... F04B 39/0044 417/363
D636,474 S 4/2011 Choi et al.
7,963,117 B2 6/2011 Allen et al.
8,056,351 B2 11/2011 Marciano et al.
8,056,933 B2 11/2011 Liptak
8,141,377 B2 3/2012 Connell et al.
D657,032 S 4/2012 Chouji
D657,033 S 4/2012 Chouji
D657,036 S 4/2012 Vetu et al.
D657,857 S 4/2012 Choi
D661,386 S 6/2012 Bergin
8,240,168 B2 8/2012 Holguin
8,371,827 B2 * 2/2013 Lilie ..... F04B 39/127 417/363
8,424,776 B2 4/2013 Veettil et al.
8,440,143 B2 5/2013 Liptak
8,535,127 B2 9/2013 Malott
8,568,209 B2 10/2013 Boxum
D693,798 S 11/2013 Chuang et al.
D709,604 S 7/2014 Qin et al.
D712,531 S 9/2014 Bergin
D715,907 S 10/2014 Bergin

(56) References Cited

U.S. PATENT DOCUMENTS

| | | | | |
|---|---|---|---|---|
| 8,869,547 | B2 | 10/2014 | Nishino et al. | |
| D716,925 | S | 11/2014 | Bergin | |
| 8,888,468 | B2 * | 11/2014 | Maganhoto | F04B 39/127 417/363 |
| 8,899,059 | B2 | 12/2014 | Barnes et al. | |
| D726,295 | S | 4/2015 | Kim et al. | |
| D754,319 | S | 4/2016 | Park et al. | |
| 9,302,605 | B1 | 4/2016 | Van Pelt | |
| D762,289 | S | 7/2016 | Schmidt et al. | |
| D764,034 | S | 8/2016 | Schmidt et al. | |
| D764,035 | S | 8/2016 | Schmidt et al. | |
| 9,493,054 | B2 | 11/2016 | Lewis et al. | |
| 9,631,832 | B2 | 4/2017 | Malott | |
| D785,771 | S | 5/2017 | Bergin | |
| D785,772 | S | 5/2017 | Bergin | |
| 9,651,284 | B2 | 5/2017 | Esch | |
| D795,712 | S | 8/2017 | Bergin et al. | |
| 9,845,798 | B2 * | 12/2017 | Miguel | F04B 39/121 |
| D811,566 | S | 2/2018 | Liu et al. | |
| D812,208 | S | 3/2018 | Samuels | |
| D817,466 | S | 5/2018 | Moseley | |
| 9,975,405 | B2 | 5/2018 | Siddiqui et al. | |
| 9,995,294 | B2 * | 6/2018 | Miguel | F04B 53/14 |
| D824,387 | S | 7/2018 | Oberpriller | |
| D824,499 | S | 7/2018 | Williamson et al. | |
| D824,501 | S | 7/2018 | Long et al. | |
| 10,082,345 | B1 | 9/2018 | Mihail | |
| 10,093,152 | B2 | 10/2018 | Allard et al. | |
| 10,107,520 | B2 | 10/2018 | Schmidt et al. | |
| D834,961 | S | 12/2018 | Bergin et al. | |
| D841,138 | S | 2/2019 | Williamson et al. | |
| D850,609 | S | 6/2019 | Bergin | |
| D852,343 | S | 6/2019 | Kosuge et al. | |
| D862,668 | S | 10/2019 | Moseley | |
| D865,914 | S | 11/2019 | Snyder | |
| D865,926 | S | 11/2019 | Moseley | |
| 10,508,867 | B2 | 12/2019 | Dowell, Jr. et al. | |
| 10,589,593 | B2 | 3/2020 | Westendarp et al. | |
| 10,626,859 | B2 * | 4/2020 | Ki | F04B 39/127 |
| D884,870 | S | 5/2020 | Bergin | |
| D885,541 | S | 5/2020 | Schumann | |
| 10,675,941 | B2 | 6/2020 | Williamson et al. | |
| 10,696,129 | B2 | 6/2020 | Bergin | |
| 10,753,350 | B2 * | 8/2020 | Ha | F04B 39/123 |
| D903,075 | S | 11/2020 | Huang et al. | |
| D905,217 | S | 12/2020 | Hederstierna et al. | |
| D907,183 | S | 1/2021 | Meda et al. | |
| D914,186 | S | 3/2021 | Brown et al. | |
| 10,941,955 | B2 | 3/2021 | Heral | |
| D915,569 | S | 4/2021 | Meda et al. | |
| D917,036 | S | 4/2021 | Hederstierna et al. | |
| 11,034,208 | B2 | 6/2021 | Williamson et al. | |
| D940,289 | S | 1/2022 | Hederstierna et al. | |
| 11,639,083 | B2 | 5/2023 | Henderson et al. | |
| 2001/0027661 | A1 | 10/2001 | Nishikawa et al. | |
| 2003/0160141 | A1 | 8/2003 | Yamanashi | |
| 2004/0040325 | A1 | 3/2004 | Evans | |
| 2005/0127697 | A1 | 6/2005 | Berry | |
| 2005/0160709 | A1 | 7/2005 | Hollis | |
| 2005/0193762 | A1 | 9/2005 | Bae | |
| 2006/0022904 | A1 | 2/2006 | Kwak et al. | |
| 2006/0052050 | A1 | 3/2006 | Malott et al. | |
| 2007/0151273 | A1 | 7/2007 | Nelson et al. | |
| 2007/0227693 | A1 | 10/2007 | Allen et al. | |
| 2007/0289325 | A1 | 12/2007 | Stone | |
| 2007/0295017 | A1 | 12/2007 | Pannell | |
| 2008/0014854 | A1 | 1/2008 | Tigner | |
| 2008/0110185 | A1 | 5/2008 | Veettil et al. | |
| 2008/0202138 | A1 | 8/2008 | Pabisz et al. | |
| 2008/0314072 | A1 | 12/2008 | Plank et al. | |
| 2009/0038774 | A1 | 2/2009 | Ogiso et al. | |
| 2009/0209193 | A1 | 8/2009 | Kloster et al. | |
| 2011/0030399 | A1 | 2/2011 | Lifson et al. | |
| 2011/0061414 | A1 | 3/2011 | McAllister, II et al. | |
| 2013/0205811 | A1 | 8/2013 | Esch | |
| 2013/0340982 | A1 | 12/2013 | Johnson et al. | |
| 2014/0223928 | A1 | 8/2014 | Esch | |
| 2015/0360568 | A1 | 12/2015 | Champagne et al. | |
| 2016/0288618 | A1 | 10/2016 | Katoh et al. | |
| 2016/0311288 | A1 | 10/2016 | Mayo Mayo et al. | |
| 2016/0311291 | A1 | 10/2016 | Shimoyama et al. | |
| 2016/0318368 | A1 | 11/2016 | Alger et al. | |
| 2017/0203632 | A1 | 7/2017 | Westendarp et al. | |
| 2019/0047353 | A1 | 2/2019 | Williamson et al. | |
| 2019/0047354 | A1 | 2/2019 | Williamson et al. | |
| 2019/0315197 | A1 | 10/2019 | Williamson et al. | |
| 2020/0132336 | A1 | 4/2020 | Muderlak | |
| 2020/0148028 | A1 | 5/2020 | Westendarp et al. | |
| 2020/0198438 | A1 | 6/2020 | Liu et al. | |
| 2020/0298655 | A1 | 9/2020 | Williamson et al. | |
| 2020/0338951 | A1 | 10/2020 | Paci et al. | |
| 2020/0376993 | A1 | 12/2020 | Jun et al. | |
| 2021/0061054 | A1 | 3/2021 | Meda et al. | |
| 2021/0061058 | A1 | 3/2021 | Meda et al. | |
| 2021/0061060 | A1 | 3/2021 | Meda et al. | |
| 2021/0207882 | A1 | 7/2021 | Jurek | |
| 2021/0239105 | A1 | 8/2021 | Allard et al. | |
| 2021/0276396 | A1 | 9/2021 | Jurek | |
| 2021/0354526 | A1 | 11/2021 | Williamson et al. | |
| 2022/0001718 | A1 | 1/2022 | Jurek | |
| 2022/0009306 | A1 | 1/2022 | Hornung | |

FOREIGN PATENT DOCUMENTS

| | | | |
|---|---|---|---|
| AU | 2007202766 | A1 | 1/2008 |
| AU | 2007237183 | A1 | 6/2008 |
| AU | 2009233601 | A1 | 6/2010 |
| AU | 2012261549 | A1 | 1/2013 |
| AU | 354553 | S | 3/2014 |
| AU | 360022 | S | 1/2015 |
| AU | 360131 | S | 1/2015 |
| AU | 360132 | S | 1/2015 |
| AU | 367405 | S | 3/2016 |
| AU | 201610870 | | 4/2016 |
| AU | 201611751 | S | 5/2016 |
| AU | 201612249 | S | 5/2016 |
| AU | 201613591 | S | 7/2016 |
| AU | 201613592 | S | 7/2016 |
| AU | 201613593 | S | 7/2016 |
| AU | 20160101949 | A4 | 12/2016 |
| AU | 2015289763 | A1 | 1/2017 |
| AU | 2017100215 | A4 | 3/2017 |
| AU | 201712794 | S | 5/2017 |
| AU | 201712798 | S | 5/2017 |
| AU | 2017200186 | A1 | 8/2017 |
| AU | 201810968 | S | 3/2018 |
| AU | 201810969 | S | 3/2018 |
| AU | 201810970 | S | 3/2018 |
| AU | 201810971 | S | 3/2018 |
| AU | 201810972 | S | 3/2018 |
| AU | 201810973 | S | 3/2018 |
| AU | 201810975 | S | 3/2018 |
| AU | 201810977 | S | 3/2018 |
| AU | 201810978 | S | 3/2018 |
| AU | 201816419 | S | 1/2019 |
| AU | 201910037 | S | 2/2019 |
| AU | 201910038 | S | 2/2019 |
| AU | 201911094 | S | 4/2019 |
| AU | 201912125 | S | 6/2019 |
| AU | 2017364256 | A1 | 6/2019 |
| AU | 2019202512 | A1 | 10/2019 |
| AU | 201915241 | S | 12/2019 |
| AU | 201916406 | S | 12/2019 |
| AU | 201916408 | S | 12/2019 |
| AU | 201916409 | S | 12/2019 |
| AU | 2018366469 | A1 | 5/2020 |
| AU | 202016120 | S | 1/2021 |
| AU | 202016121 | S | 1/2021 |
| AU | 202016122 | S | 1/2021 |
| AU | 202016123 | S | 1/2021 |
| CA | 2518348 | A1 | 3/2006 |
| CA | 2578651 | A1 | 8/2007 |
| CA | 2587994 | A1 | 12/2007 |
| CA | 2611822 | A1 | 5/2008 |

(56) References Cited

FOREIGN PATENT DOCUMENTS

| | | | |
|---|---|---|---|
| CA | 2500519 | C | 9/2009 |
| CA | 2686403 | A1 | 5/2010 |
| CA | 2906348 | A1 | 9/2014 |
| CA | 2951956 | A1 | 12/2015 |
| CA | 2954152 | A1 | 1/2016 |
| CA | 166803 | S | 3/2016 |
| CA | 166804 | S | 3/2016 |
| CA | 165232 | S | 5/2016 |
| CA | 165233 | S | 5/2016 |
| CA | 167369 | S | 12/2016 |
| CA | 170638 | S | 12/2016 |
| CA | 167431 | S | 2/2017 |
| CA | 172872 | S | 2/2017 |
| CA | 172873 | S | 2/2017 |
| CA | 172874 | S | 2/2017 |
| CN | 1436677 | A | 8/2003 |
| CN | 101509717 | A | 8/2009 |
| CN | 201392053 | Y | 1/2010 |
| CN | 103237671 | A | 8/2013 |
| CN | 103687735 | A | 3/2014 |
| CN | 203623791 | U | 6/2014 |
| CN | 104044432 | U | 9/2014 |
| CN | 203920328 | U | 11/2014 |
| CN | 104325923 | A | 2/2015 |
| CN | 106470856 | A | 3/2017 |
| CN | 106895502 | A | 6/2017 |
| CN | 106976376 | A | 7/2017 |
| CN | 109070688 | A | 12/2018 |
| CN | 305029216 | S | 2/2019 |
| CN | 305029217 | S | 2/2019 |
| CN | 305029218 | S | 2/2019 |
| CN | 305105066 | S | 4/2019 |
| CN | 110293813 | A | 10/2019 |
| CN | 110385958 | A | 10/2019 |
| CN | 305397384 | S | 10/2019 |
| CN | 111344168 | A | 6/2020 |
| CN | 213237518 | U | 5/2021 |
| CN | 213237945 | U | 5/2021 |
| CN | 306672354 | S | 7/2021 |
| CN | 306681352 | S | 7/2021 |
| CN | 306901266 | S | 10/2021 |
| DE | 2723318 | A1 | 12/1978 |
| DE | 19654261 | A1 | 6/1998 |
| DE | 19730136 | A1 | 1/1999 |
| DE | 69503723 | T2 | 4/1999 |
| DE | 69817899 | T2 | 5/2004 |
| DE | 10255833 | A1 | 6/2004 |
| DE | 10336767 | B3 | 12/2004 |
| DE | 59812376 | | 1/2005 |
| DE | 202004007924 | U1 | 10/2005 |
| DE | 202005013530 | U1 | 11/2005 |
| DE | 102004032920 | A1 | 3/2006 |
| DE | 202004017266 | U1 | 3/2006 |
| DE | 202005000560 | U1 | 5/2006 |
| DE | 102005030362 | B3 | 11/2006 |
| DE | 202006001377 | U1 | 5/2007 |
| DE | 202007003764 | U1 | 5/2007 |
| DE | 602004004480 | T5 | 5/2007 |
| DE | 202006001374 | U1 | 6/2007 |
| DE | 202006001376 | U1 | 6/2007 |
| DE | 202006009803 | U1 | 11/2007 |
| DE | 202007006292 | U1 | 9/2008 |
| DE | 102007038443 | A1 | 2/2009 |
| DE | 102007038716 | A1 | 2/2009 |
| DE | 602005012194 | | 2/2009 |
| DE | 202009003069 | U1 | 6/2009 |
| DE | 202008003123 | U1 | 7/2009 |
| DE | 102008028066 | A1 | 12/2009 |
| DE | 602007009584 | | 11/2010 |
| DE | 502007006725 | | 4/2011 |
| DE | 202011101256 | U1 | 11/2011 |
| DE | 202010012578 | U1 | 12/2011 |
| DE | 102011053341 | B4 | 5/2014 |
| DE | 202011002986 | U1 | 6/2014 |
| DE | 202013004158 | U1 | 8/2014 |
| DE | 102016220768 | A1 | 4/2018 |
| DE | 112017000915 | T5 | 10/2018 |
| DE | 102017207797 | A1 | 11/2018 |
| DE | 102017214941 | A1 | 2/2019 |
| DE | 102017219353 | A1 | 5/2019 |
| DE | 112017005541 | T5 | 8/2019 |
| DE | 102018204532 | A1 | 9/2019 |
| DE | 102018206490 | A1 | 10/2019 |
| DE | 102019205194 | A1 | 10/2019 |
| DE | 102018206854 | A1 | 11/2019 |
| DE | 202015009786 | U1 | 2/2020 |
| DE | 212018000248 | U1 | 2/2020 |
| DE | 212018000249 | U1 | 2/2020 |
| DE | 112018003284 | T5 | 3/2020 |
| DE | 112018003288 | T5 | 4/2020 |
| DE | 102018222877 | A1 | 6/2020 |
| DE | 112018005002 | T5 | 7/2020 |
| DE | 112018005883 | T5 | 7/2020 |
| DE | 102020203424 | B3 | 7/2021 |
| DE | 112020000265 | T5 | 9/2021 |
| DE | 102020206181 | A1 | 11/2021 |
| DE | 102020206182 | A1 | 11/2021 |
| DE | 102020206183 | A1 | 11/2021 |
| EM | 005811890-0001 | | 10/2018 |
| EM | 005811890-0002 | | 10/2018 |
| EM | 005811890-0003 | | 10/2018 |
| EM | 005811890-0004 | | 10/2018 |
| EP | 0700801 | A1 | 3/1996 |
| EP | 0863030 | A2 | 9/1998 |
| EP | 0869018 | A2 | 10/1998 |
| EP | 0892225 | A2 | 1/1999 |
| EP | 1140533 | B1 | 1/2003 |
| EP | 1502785 | A1 | 2/2005 |
| EP | 1538009 | A1 | 6/2005 |
| EP | 1538411 | A2 | 6/2005 |
| EP | 1468852 | B1 | 12/2005 |
| EP | 0921361 | B1 | 2/2006 |
| EP | 1634740 | A1 | 3/2006 |
| EP | 1721765 | A1 | 11/2006 |
| EP | 1752717 | A1 | 2/2007 |
| EP | 1826041 | A1 | 8/2007 |
| EP | 1870270 | A1 | 12/2007 |
| EP | 1925889 | A2 | 5/2008 |
| EP | 1955946 | A2 | 8/2008 |
| EP | 1988612 | A2 | 11/2008 |
| EP | 1526974 | B1 | 1/2009 |
| EP | 2048011 | A1 | 4/2009 |
| EP | 2178710 | A1 | 4/2010 |
| EP | 2189312 | A1 | 5/2010 |
| EP | 2192040 | A1 | 6/2010 |
| EP | 2196390 | A1 | 6/2010 |
| EP | 2433658 | A1 | 3/2012 |
| EP | 2616258 | A1 | 7/2013 |
| EP | 2665611 | A1 | 11/2013 |
| EP | 2994326 | A1 | 3/2016 |
| EP | 3113965 | A1 | 1/2017 |
| EP | 3241695 | A2 | 11/2017 |
| EP | 3303965 | A2 | 4/2018 |
| EP | 2714440 | B1 | 5/2018 |
| EP | 3401619 | A1 | 11/2018 |
| EP | 3411250 | A1 | 12/2018 |
| EP | 3476630 | A1 | 5/2019 |
| EP | 3543047 | A1 | 9/2019 |
| EP | 3564564 | A1 | 11/2019 |
| EP | 3592585 | A1 | 1/2020 |
| ES | 1056812 | U | 5/2004 |
| ES | 1056841 | U | 5/2004 |
| ES | 1059964 | U | 7/2005 |
| ES | 1059965 | U | 7/2005 |
| FR | 2726352 | A1 | 5/1996 |
| GB | 765498 | A | 1/1957 |
| GB | 1127586 | A | 9/1968 |
| GB | 2349687 | A | 11/2000 |
| JP | 8594307 | U | 1/1984 |
| JP | 2005164231 | A | 6/2005 |
| KR | 2000034096 | A | 6/2000 |
| KR | 2000034097 | A | 6/2000 |
| KR | 822168 | B1 | 4/2008 |
| KR | 822169 | B1 | 4/2008 |

(56) References Cited

FOREIGN PATENT DOCUMENTS

| | | | |
|---|---|---|---|
| NL | 1011332 | C2 | 8/2000 |
| RU | 2753994 | C2 | 8/2021 |
| WO | 2000063036 | A1 | 10/2000 |
| WO | 0206698 | A1 | 1/2002 |
| WO | 2004090440 | A1 | 10/2004 |
| WO | 2004098933 | A1 | 11/2004 |
| WO | 2005108135 | A1 | 11/2005 |
| WO | 2009021994 | A1 | 2/2009 |
| WO | 2009055891 | A1 | 5/2009 |
| WO | 2012034695 | A1 | 3/2012 |
| WO | 2012113538 | A1 | 8/2012 |
| WO | 2012159749 | A1 | 11/2012 |
| WO | 2014143181 | A1 | 9/2014 |
| WO | 2014180559 | A1 | 11/2014 |
| WO | 2015013794 | A1 | 2/2015 |
| WO | 2016011073 | A1 | 1/2016 |
| WO | 2016120337 | A1 | 8/2016 |
| WO | 2016166320 | A1 | 10/2016 |
| WO | 2016189520 | A2 | 12/2016 |
| WO | 2017143393 | A1 | 8/2017 |
| WO | 2017143394 | A1 | 8/2017 |
| WO | 2018096127 | A1 | 5/2018 |
| WO | 2019025633 | A1 | 2/2019 |
| WO | 2019025634 | A1 | 2/2019 |
| WO | 2019025635 | A1 | 2/2019 |
| WO | 2019025636 | A1 | 2/2019 |
| WO | 2019038023 | A1 | 2/2019 |
| WO | 2019082168 | A1 | 5/2019 |
| WO | 2019097448 | A1 | 5/2019 |
| WO | 2019207451 | A1 | 10/2019 |
| WO | 2019229706 | A1 | 12/2019 |
| WO | 2019244011 | A1 | 12/2019 |
| WO | 2020151541 | A1 | 7/2020 |
| WO | 2020192746 | A1 | 10/2020 |
| WO | 2021074841 | A1 | 4/2021 |
| WO | 2021186414 | A1 | 9/2021 |
| WO | 2021228601 | A1 | 11/2021 |
| WO | 2021228605 | A1 | 11/2021 |
| WO | 2021228620 | A1 | 11/2021 |

OTHER PUBLICATIONS

International Searching Authority, Invitation to Pay Additional Fees and Partial Search Report for PCT/IB2019/053280 dated Aug. 19, 2019, 8 pages.

International Searching Authority, International Search Report and Written Opinion for PCT/IB2019/053280 dated Oct. 16, 2019 and dated Oct. 24, 2019, 22 pages.

U.S. Appl. No. 62/661,468, filed Apr. 23, 2018 entitled "Damped Mobile Compressor".

Australian application No. 201910037, "Air conditioner," filed on Jan. 4, 2019.

Australian application No. 201910038, "Air conditioner," filed on Jan. 4, 2019.

Australian application No. 201816419, "Air conditioner" filed on Oct. 26, 2018.

American RV Company, Dometic 459530 Duo Therm 13,500 BTU Brisk Air Conditioner High Efficiency Upper Unit Trailer Camper RV, Mar. 23, 2014 https://web.archive.org/web/20140323013456/http://www.americanrvcompany.com/Dometic-459530-Duo-Therm-13500-BTU-Brisk-Air-Conditioner-High-Efficiency-Upper-Unit-Trailer-Camper-RV Mar. 23, 2014.

American RV Company, Dometic 541815 High Performance 13,500 BTU Air Conditioner Upper Unit CCC2 Required Electronics Pre-Installed Camper Trailer RV, http://www.americanrvcompany.com/Dometic-541815-High-Performance-13500-BTU-Air-Conditioner-Upper-Unit-CCC2-Required-Electronics-Pre-Installed-Camper-Trailer-RV Mar. 23, 2014.

American RV Company, Dometic 541816 High Performance 15,000 BTU Air Conditioner Upper Unit CCC2 Required Electronics Pre-Installed Camper Trailer RV, http://www.americanrvcompany.com/Dometic-541816-High-Performance-15000-BTU-Air-Conditioner-Upper-Unit-CCC2-Required-Electronics-Pre-Installed-Camper-Trailer-RV Mar. 23, 2014.

American RV Company, Dometic 541916 High Performance 15,000 BTU Air Conditioner Upper Unit Single Zone CD Thermostat Required Electronics Pre-Installed Camper Trailer RV, http://www.americanrvcompany.com/Dometic-541916-High-Performance-15000-BTU-Air-Conditioner-Upper-Unit-Single-Zone-LCD-Thermostat-Required-Electronics-Pre-Installed-Camper-Trailer-RV Mar. 23, 2014.

American RV Company, Dometic 551816 High Performance 15,000 BTU Heat Pump for Comfort Control Center II Camper Trailer RV, http://www.americanrvcompany.com/Dometic-551816-High-Performance-15000-BTU-Heat-Pump-for-Comfort-Control-Center-I I-Camper-Trailer-RV Mar. 23, 2014.

Australian Patent Application No. 2019259641 titled "Damped Mobile Compressor" filed on Oct. 20, 2020.

Chinese application No. 201830607654.X, "Mobile Air conditioner," filed on Oct. 30, 2018.

Chinese application No. 201980028248.X "Damped Mobile Compressor" filed on Oct. 22, 2020.

Dometic Group: "Climate Control", http://www.dometic.com/enus/Americas/USA/RV-Products/climate, 2 pages.

Dometic Corporation, Dometic High Performance Air Conditioners, 2 pages, Jan. 1, 2011.

Dometic 2015 Product Catalog, Climate Control (2015).

Dometic 2016 Product Catalog, Climate Control (2016).

Dometic Duo-Therm, p. 140, Feb. 23, 2013.

Dometic Waeco Coolair RT 880; http://www.dometic.co.uk/product/waeco-coolair-rt-880-2/ May 14, 2015.

European Patent Application No. 19727497 tiltled "Damped Mobile Compressor" filed Oct. 20, 2020.

European Design Application No. 005811890-0001-0004 tiltled "Mobile Air Conditioner" filed Oct. 29, 2018.

Invitation to Pay Additional Fee for International Application No. PCT/IB2020/052438 dated Jul. 9, 2020.

Notice of Allowance Issued in U.S. Appl. No. 29/645,887 dated Aug. 30, 2021.

Restriction Requirement Issued for U.S. Appl. No. 29/645,887 dated May 21, 2021.

Search Report and Written Opinion received in PCT Application PCT/IB2020/052438 dated Oct. 7, 2020.

U.S. Appl. No. 63/175,304 titled "Mobile Air Conditioner" filed Apr. 15, 2021.

Design U.S. Appl. No. 29/645,887 titled "Mobile Air Conditioner" filed Apr. 30, 2018.

Design U.S. Appl. No. 29/798,939 titled "Housing Shroud and Housing for an Air Conditioner" filed Jul. 12, 2021.

U.S. Appl. No. 17/477,343 titled "Mobile Air Conditioner" filed Sep. 16, 2021.

U.S. Appl. No. 17/440,104 titled "Mobile Air Conditioner" filed Sep. 16, 2021.

Corrected Notice of Allowance Issued in U.S. Appl. No. 29/645,887 dated Sep. 29, 2021.

International Preliminary Report on Patentability Issued in PCT Application No. PCT/IB2020/052438 dated Sep. 16, 2021.

Corrected Notice of Allowance Issued in U.S. Appl. No. 29/645,887 dated Oct. 14, 2021.

Corrected Notice of Allowance Issued in U.S. Appl. No. 29/645,887 dated Oct. 28, 2021.

Office Action Issued in China Application No. 201980028248.X dated Dec. 22, 2021.

U.S. Appl. No. 63/061,462 titled "Modular Compressor Cooling Unit, Appliance, and Method Therefore" filed Aug. 5, 2020.

U.S. Appl. No. 17/579,442 titled "Heating Arrangement and Heat Distribution Unit for Such a Heating Arrangement" filed Jan. 19, 2022.

U.S. Appl. No. 17/673,080 titled "Recreational Vehicle, Cooling Device, Controlling System and Method for Controlling the Cooling Device" filed Feb. 16, 2022.

U.S. Appl. No. 62/992,595 titled "Heating, Ventilation and Air Conditioning System with Illumination" filed Mar. 20, 2020.

U.S. Appl. No. 62/819,711 titled "Mobile Air Conditioner" filed Mar. 18, 2019.

(56) References Cited

OTHER PUBLICATIONS

U.S. Appl. No. 29/767,929 titled "Air Conditioning Housing" filed Jan. 26, 2021.
U.S. Appl. No. 63/141,800 titled "Air Conditioning System for a Vehicle" filed Jan. 26, 2021.
U.S. Appl. No. 29/774,535 titled "Air Distribution Box" filed Mar. 17, 2021.
U.S. Appl. No. 29/641,674 titled "Control Panel" filed Mar. 23, 2018.
U.S. Appl. No. 29/645,887 titled "Mobile Air Conditioner" filed Apr. 30, 2018.
U.S. Appl. No. 29/715,592 titled "Filter Housing" filed Dec. 3, 2019.
U.S. Appl. No. 29/758,314 titled "Air Conditioning Apparatus" filed Nov. 13, 2020.
U.S. Appl. No. 29/760,605 titled "Air Conditioning Apparatus" filed Dec. 2, 2020.
U.S. Appl. No. 62/661,468 titled "Damped Mobile Compressor" filed Apr. 23, 2018.
U.S. Appl. No. 62/686,217 titled "Heating, Ventilation and Air Conditioning System with Illumination" filed Jun. 18, 2018.
Office Action Issued in China Application No. 201980028248.X dated Jul. 29, 2022.
Office Action issued in EP Application No. 19727497.0 dated Dec. 12, 2022.
Decision to Grant Issued in China Application No. 201980028248.X dated Jan. 4, 2023.
Non-Final Office Action issued in U.S. Appl. No. 17/440,104 dated May 12, 2023.
Non-Final Office Action issued in U.S. Appl. No. 29/798,939 dated Jun. 8, 2023.
Patent Certificate Issued in China Application No. 201980028248.X dated Feb. 17, 2023.
Non-Final Office Action issued in U.S. Appl. No. 17/477,343 dated Jan. 19, 2023.
Final Office Action issued in U.S. Appl. No. 17/477,343 dated Aug. 14, 2023.
Advisory Action issued in U.S. Appl. No. 17/477,343 dated Oct. 27, 2023.
Notice of Allowance issued in U.S. Appl. No. 17/440,104 dated Oct. 31, 2023.
Notice of Allowance issued in U.S. Appl. No. 17/477,343 dated Dec. 6, 2023.
Office Action issued in DE Patent Application No. 102022203759.6 dated Nov. 30, 2023.
Notice of Allowance issued in U.S. Appl. No. 29/798,939 dated Jan. 2, 2024.
Notice of Allowability issued in U.S. Appl. No. 17/440,104 dated Jan. 19, 2024.

* cited by examiner

DAMPED MOBILE COMPRESSOR

CLAIM TO PRIORITY

This 35 U.S.C. § 371 National Stage Patent Application claims priority to PCT Patent Application No. PCT/IB2019/053280, filed Apr. 19, 2019, and titled "Damped Mobile Compressor" which claims priority to and benefit of U.S. Provisional Patent Application Ser. No. 62/661,468, filed Apr. 23, 2018 and titled "Damped Mobile Compressor", all of which is incorporated by reference herein.

BACKGROUND

Field of the Invention

The present embodiments relate to an appliance for use in mobile applications with improved compressor damping. More specifically, present embodiments relate to a compressor for refrigerator cooling having improved stabilization of components within a housing to limit noise and contact related damage between the components and the housing.

Description of the Related Art

The use of small refrigerators on-board over-the-road haul trucks (or tractors) or other mobile mechanisms such as a recreational vehicle ("RV") is highly desirable in order to maintain fresh and/or frozen foods. The refrigerators may have various types of cooling systems including, but not limited to, compression/refrigerant technologies.

When utilized in the sleeper area of a truck, some refrigerators may be located in an area of the sleeper cab. The sleeper area, by virtue of its design, is partially enclosed from the remainder of the truck cab depending on where the user sleeps and where the refrigerator is located, the refrigerator may be close to a user's head. This means that operations of the refrigerator must be quiet or sleep is interrupted for the user. This is highly undesirable especially if the user is the driver of the vehicle and needs rest in order to return driving duties safely.

Many of these types of refrigeration systems are designed for static use, for example in homes or fixed structures such as commercial buildings or college dorms, where these smaller refrigerators are typically used. However, when used for mobile operations, the compressors may make noise due to internal compressor parts hitting or otherwise contacting the compressor housing during startup, shutdown or at speeds therebetween due to the movement of the vehicle. This leads to undesirable noise as well as accelerated decline of performance due to damage.

It would be desirable to overcome such noises and reduce any damage associated with contact between compressor components and a compressor housing.

It would be desirable to limit such contact between the housing and internal components.

The information included in this Background section of the specification, including any references cited herein and any description or discussion thereof, is included for technical reference purposes only and is not to be regarded subject matter by which the scope of the invention is to be bound.

SUMMARY

The present application discloses one or more features recited in the appended claims and/or the following features which, alone or in any combination, may comprise patentable subject matter.

Present embodiments provide a compressor used in mobile appliances. The appliances may comprise various types such as, for non-limiting example, a refrigerator or an air conditioner, any of which comprises a compressor having compression components disposed within a housing and in fluid communication with a refrigerant system. The present embodiments provide that within the housing there is an improved damping or stabilizer structures which limits movement of electric and/or mechanical components, or both, within the housing. At startup and shutdown, when oscillations of the compression components within the housing are generally maximized, the components are limited from contacting the housing internal structure so as to inhibit damage to the compressor and reduce the noise associated with such contact. Additionally, the damped compressor is limited from contacting the housing during movement of the vehicle. This also may limit damage over the life of the refrigerator or air conditioner, for example.

According to some embodiments, a mobile refrigerant compressor comprises a housing enclosing at least a motor and a compressor body, a first damper engaging the housing and one of the compressor body and the motor, a second damper engaging the housing and the at least one of the compressor body and the motor.

According to some optional embodiments, the following may be used independently with the previous embodiment or in combination with one or more of the other optional embodiments and the previous embodiment.

In some embodiments, the first damper may be a spring.

In some embodiments, the spring may be one of a leaf spring, a coil spring or a conical spring.

In some embodiments, the spring may having a first landing and a second landing.

In some embodiments, the landings may be engaged by a retainer.

In some embodiments, the retainer may also engage one of the compressor body or a compressor head.

In some embodiments, the second damper may be disposed against the housing and provide a second force on the one of the motor and compressor body.

In some embodiments, the second damper may limit lateral movement of the motor and compressor body.

In some embodiments, the first damper and the second damper may be preloaded when the compressor is assembled.

In some embodiments, the second damper may act in a direction opposite the first damper.

According to some other embodiments, a mobile compressor for a refrigeration system may comprise a compressor in fluid communication with the refrigeration system, a housing having a first housing portion and a second housing portion, a motor and a compressor body disposed in the housing, a first damper engaging the housing and one of the motor and compressor body and creating an urging force in one direction, a second damper engaging the housing and the other of the motor and compressor body and creating a second urging force in a second direction.

According to some optional embodiments, the following may be used independently with the previous embodiment or in combination with one or more of the other optional embodiments and the previous embodiment.

In some embodiments, the first damper and the second damper inhibit contact of the motor and the compressor body with the housing.

In some embodiments, the first damper may have one of constant thickness or varying thickness.

In some embodiments, the second damper may be a single damper or a plurality of dampers.

In some embodiments, the second damper may have at least one locating feature.

In some embodiments, the second damper may have at least a 70 Durometer Shore A scale.

In some embodiments, the second damper may have sufficient force to resist an opposing force of the spring.

In some embodiments, the compressor may be disposed in one of a mobile refrigerator or a mobile air conditioner.

In some embodiments, the first direction may differ from the second direction.

According to still other embodiments, a method of damping a mobile refrigeration system may comprise the steps of positioning a compressor body and a motor in a housing, applying a first preload to one of the motor and compressor body, applying a second preload to the other of the motor and the compressor body, damping the motor and compressor body movement within the housing.

According to a still further embodiment, a method of damping a mobile refrigeration system, comprising the steps of positioning a compressor body and a motor in a housing, applying a first preload to one of the motor and compressor body, applying a second preload to the other of the motor and the compressor body, damping the motor and compressor body movement within the housing, applying a third preload on a first side of the motor and the compressor body and, applying a fourth preload on a second side of the motor and the compressor body.

According to a still further embodiment, a mobile refrigerant compressor, comprising a housing having a first portion and a second portion, a motor and a compressor defining compressor mechanicals disposed within the housing, a lateral damper engaging one of the compressor mechanicals or the housing, the lateral damper limiting lateral movement of at least one of the compressor mechanicals relative to the housing, and a vertical retainer which limits vertical movement of the other of the compressor mechanicals.

In some embodiments, the lateral damper may be a first and second damper on two sides of the housing. The first damper may be two dampers and the second damper may be two dampers.

In some embodiments, the mobile refrigerant compressor may comprise a bracket disposed on the housing. The vertical retainer may engage the bracket. The vertical retainer may be fastened to the bracket. The vertical retainer may engage two dampers on a first side of the compressor.

In some embodiments the mobile refrigerant compressor further comprising a second vertical retainer engaging two dampers on a second side of the compressor.

In some embodiments the mobile refrigerant compressor further comprising a lug formed in said housing beneath said lateral damper.

According to a still further embodiment, a mobile refrigerant compressor, comprising a housing having a compressor and motor therein, the housing configured to receive a fluid refrigerant for compression by the compressor, a first damper engaging one of the motor and the compressor or engaging the housing to limit motion in at least one horizontal direction, a retainer engaging the other of the one of the motor and the compressor or the housing, the retainer engaging the first damper and limiting vertical motion.

In some embodiments, the retainer may be substantially U-shaped, the retainer also limiting movement of the motor and compressor in a horizontal direction.

In some embodiments, the mobile refrigerant compressor further comprising a boss disposed in the housing beneath the first damper, the first damper being two dampers spaced apart.

In some embodiments, the motor and compressor seated on one of springs or dampers.

All of the above outlined features are to be understood as exemplary only and many more features and objectives of a damping embodiment for mobile compressor and may be gleaned from the disclosure herein. Therefore, no limiting interpretation of this summary is to be understood without further reading of the entire specification, claims and drawings, included herewith.

BRIEF DESCRIPTION OF THE DRAWINGS

In order that the embodiments may be better understood, damping embodiments of a mobile compressor will now be described by way of examples. These embodiments are not to limit the scope of the claims as other damping embodiments of the mobile compressor will become apparent to one having ordinary skill in the art upon reading the instant description. Non-limiting examples of the present embodiments are shown in figures wherein:

DETAILED DESCRIPTION

Figure 1:
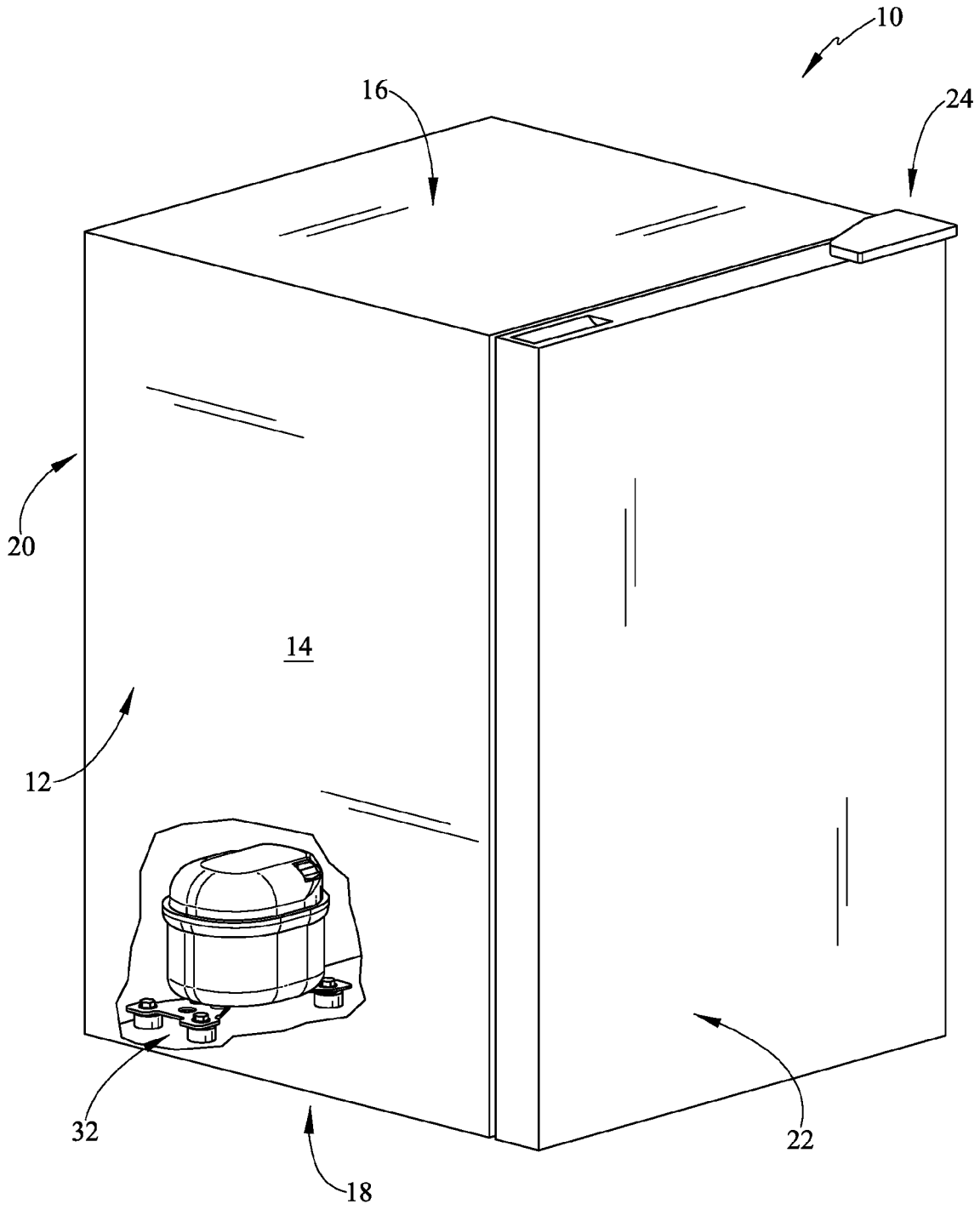
FIG. 1 is a perspective view of a mobile appliance with a cut away depicting an example of a damped compressor.

It is to be understood that the damped mobile compressor is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The various embodiments provide damper arrangements, including springs and/or other damping structures at preselected locations. The term damper is meant to be broad and may include springs or other structures, which provide a force and/or limit movement of the components being acted upon, but is not exclusive of springs, unless stated otherwise explicitly.

Referring now in detail to the drawings, wherein like numerals indicate like elements throughout several views, there are shown in FIGS. 1-20 various embodiments related to a compressor for a mobile appliance are provided which improve, inhibit or at least reduce the contact between internal components of the compressor and the inner surface of a compressor housing. This limits damage to the compressor, as well as reduces the sound emitted from the refrigeration system during startup, shutdown, or generally during operation when the appliance is moving in a vehicle, for example. Various forces are applied to internal components of the compressor and within the housing to apply a preloading to the compressor components and inhibit contact with the inner surface of the housing.

Referring now to FIG. 1, a perspective view of a mobile appliance 10 is depicted. The example provides a refrigerator which is small in size and generally suitable for use in over-the-road-trucking, RVs or other mobile applications and in some embodiments, may be sized, for example, similar to known college dorm-size refrigerator. The appliance 10 is depicted as a refrigerator and described as such throughout this specification. However, any structure utilizing a compressor and refrigeration circuit may be substituted for the refrigerator and falls within the scope of the instant application, as well as the term "appliance" used throughout.

The appliance 10 comprises a housing 12 which may include multiple sides 14, a top 16, a bottom 18, and a rear surface 20. The forward end of the housing 12 may have an opening (not shown) which is covered by a door 22 wherein fresh or frozen foods may be stored. The opening provides access to a cabinet inside the housing 12. The door 22 may be hinged to pivot between an open position and a closed position (depicted). Additionally, the appliance 10 may optionally include drawers or other structures separate and apart from the door 22 for freezing and/or refrigeration. Still further, the door 22 is shown as a single door and the pivot 24 may be located on either side of the door 22 to open the door 22 in either a right hand or left hand direction. In other embodiments, multiple doors may be utilized in a French door configuration or in still other embodiments, an upper, lower door configuration with horizontal pivot axes. Still further, arrangements are contemplated wherein the pivot axis may be horizontal.

Figure 2:
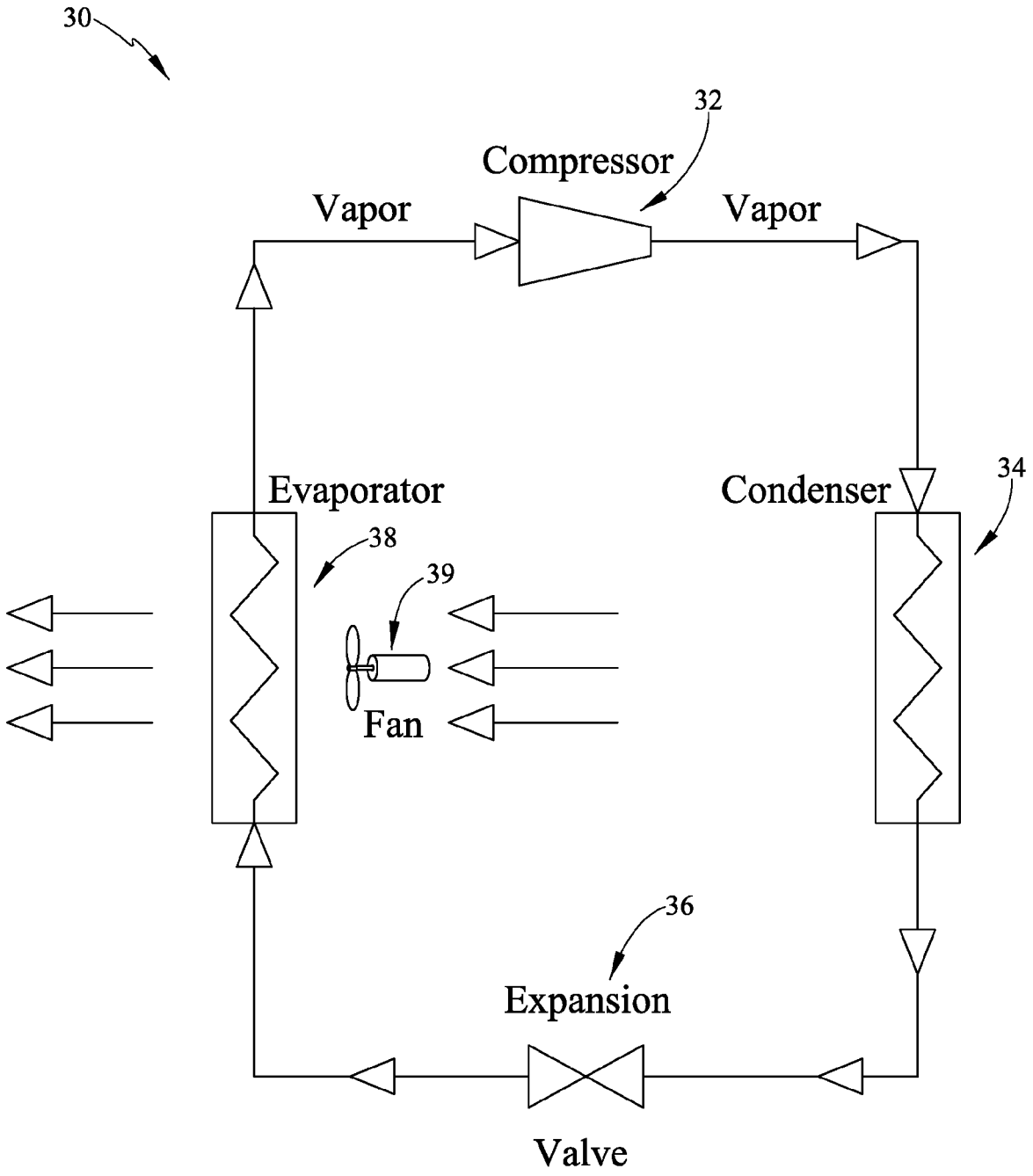
FIG. 2 is an example of a refrigeration circuit.

Within the appliance 10 is a refrigeration system or circuit 30 (FIG. 2). The refrigeration system 30 is shown partially in FIG. 1 represented by a compressor 32 shown in a cut away portion of the side 14. The compressor 32 functions as part of the refrigeration system 30 to refrigerate or freeze contents of the appliance 10.

Referring now to FIG. 2, one example of a refrigeration system 30 is depicted. The refrigeration system 30 is shown in schematic view for ease of discussion. As depicted, the compressor 32 compresses a refrigerant, which passes from the compressor 32 through the refrigeration system 30. In the circuit, the refrigerant passes through a condenser 34 which cools the vapor form refrigerant some amount. The condenser 34 may optionally include a fan (not shown) to remove heat from the vapor passing through the coil. Next, the refrigerant reaches an expansion valve 36 which reduces pressure of the partially cooled refrigerant, further cooling the refrigerant before the refrigerant passes through an evaporator 38. The evaporator 38 may have one or more coils which extend about one or more sides of the appliance 10 so as to cool a cabinet within the appliance 10. Optionally, the fan 39 may be utilized to improve heat exchange and remove such from the interior of the appliance 10. The evaporator 38 may also include an optional condenser fan which aids in heat exchange from within the appliance 10 to an exterior of the appliance 10. After passing through the evaporator 38, the refrigerant returns to the compressor 32 for the compression to pass through the cycle again.

The refrigerant may be of various types. For example, some refrigerants which may be utilized include R-11 and R-12. HCFCs such as R-22, HFCs R-134a, R600a, R1234yf, and/or R1234e which is used in many cars have replaced most CFC use. HCFCs in turn are being phased out under the Montreal Protocol and replaced by hydrofluorocarbons (HFCs), such as R-410A, which lack chlorine. Still further, newer refrigerants may include supercritical carbon dioxide, known as R-744. These have similar efficiencies compared to existing CFC and HFC based compounds, and have lower global warming potential. These are merely examples however as other refrigerants may be used.

The schematic drawing is a simple refrigeration cycle and other features and functions may be utilized. For example, additional conduit lines of further complexity may be utilized to provide the desired cooling about the internal cabinet of the appliance 10. The schematic view, therefore, is merely exemplary for depicting the general refrigeration cycle and should not be considered limiting.

Figure 3:
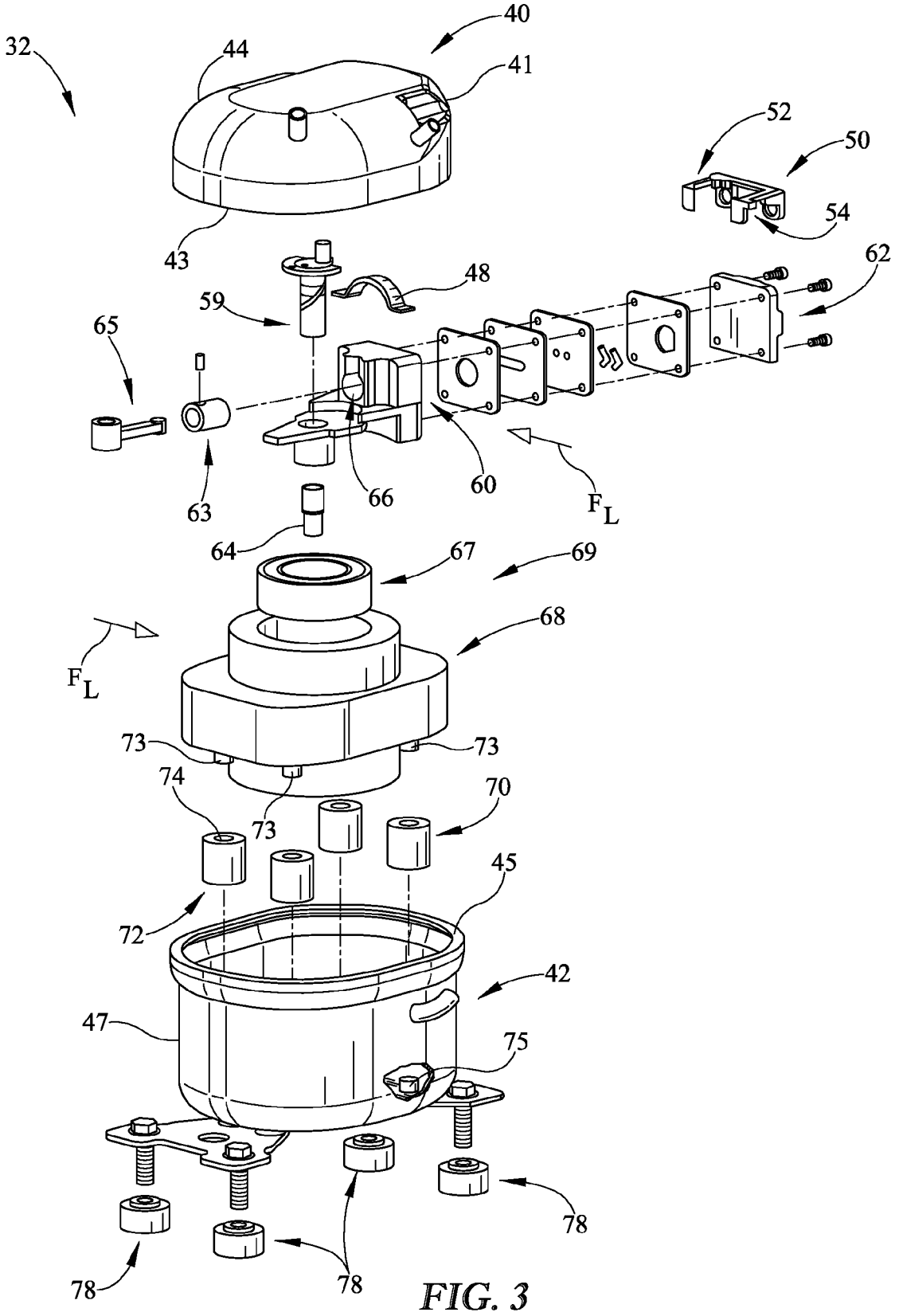
FIG. 3 is an exploded perspective view of the compressor.

Referring now to FIG. 3, an exploded perspective view of one example of the compressor 32 is shown. The compressor 32 comprises a housing 40 made up of first and second housing portions 41, 42, for non-limiting example, an upper housing portion and a lower housing portion. The compressor 32 utilizes the housing 40 to enclose a motor assembly 69 and the compressor components which perform the compression of refrigerant, and together which define the compressor mechanicals, generally. For example, the compressor components may include any of various types of compressors including, but not limited to, linear, rotary or screw, for non-limiting example, wherein the refrigerant is compressed and may include the motor. In some embodiments, the housing 40 may be formed of left and right portions, or in still other embodiments, the housing portions 41, 42 may not be in halves but instead may or may not be in symmetrical arrangements. The compressor components may also include one or more valves as well as other mounting components or retainer 50 which may be connected to any of the compressor components.

The upper housing portion 41 is generally hollow and has at least one wall 44 and a lower peripheral edge 43. The at least one wall 44 is round and depends downwardly from an uppermost area to the lower edge 43. Likewise, the lower housing portion 42 comprises at least one wall 47 and is generally hollow inside with an upper peripheral edge 45. The lower edge 43 and the upper edge 45 abut one another or may overlap to enclose the housing 40 and the plurality of contents therein. They may be fastened, welded, adhered together or other such ways to retain and/or seal them together. Both the upper and lower housing portions 41, 42 are generally concave so as to define the hollow volume therein. The housing 40 may be of various shapes but due to the mobile nature of the appliance 10, the upper and lower housing portions 41, 42 should be as small as necessary to provide the requisite fluid connections as well as enclose the compressor mechanicals and allow operation thereof. The housing 40 may be filled with refrigerant, and optionally including oil, which is circulated through the system 30.

Still further, upper and lower housing portions 41, 42 may have a damping material such as a rubber, soft plastic or other damping material adhered to or otherwise coating some or all of an interior of the housings 41, 42. This may reduce noise emitted from the compressor 32 and the appliance 10. Further, this may reduce damage of compressor components when the components contact the housing 40 interior surface.

Beneath the upper housing portion 41 is a first damper 48, for non-limiting example a leaf spring, wire spring, flat spring, coil spring or conical spring. The damper spring 48 may be depicted as a leaf spring which is generally round with two flat portions, or landings, which aid in retaining the spring 48 in position. The spring 48 engages the upper housing portion 41 and thereby places a downforce on the components beneath the spring 48. The instant embodiment provides that the spring 48 engages the upper housing portion 41 and the compressor body 60, but the spring 48 may engage other parts. When the compressor 32 is assembled, the spring 48 places a downforce on compressor components within the housing 40. This decreases movement of those parts.

The spring 48 may be formed of metal, including but not limited to alloys, or may be plastic and may be leaf, wire, flat, coil or conical according some non-limiting embodiments. Further, the amount of force may vary and may be at least in part dependent upon the size of the compressor components and the force needed to limit movement.

The spring may be held in position in a number of manners. For example, various types of retainers which may be any of fasteners, mechanical structures, or combinations thereof may be used. Further adhesives or other mechanical joinders, such as brazing or welding, may be used to position the spring 48 and may be retainers. Likewise, engagement with the upper housing 41 may also serve to retain the spring 48 in position. When the compressor 32 is assembled, the upper surface 55 (FIG. 5) of the spring 48 may engage the upper housing portion 41 to provide a downforce on the reciprocating compressor body 60 and retain the spring 48 in position due in part to downforce on the spring 48 from the upper housing portion 41. The downforce on the reciprocating compressor body 60 also aids to maintain the reciprocating compressor body 60 in position within the housing 40 and limit undesirable lateral movement of such relative to the housing 40, which may otherwise result in contact of the inner surface of the upper housing portion 41 and/or lower housing portion 42, once the assembly is completed. It should be understood that while the term downforce is used, other embodiments may be provided within the scope of the claims and that that force may be other than in the downward direction. Such force is desirable to be related to damping of the compressor components within the housing 40.

A compressor head 62 is shown exploded from the compressor body 60. The compressor body 60 may be formed by one or more parts to define an assembly for example. A plurality of gaskets and seals and valves may be disposed between the compressor body 60 and the compressor head 62. These structures may also define portions of the compressor components in general.

To the left of the depicted compressor body 60 is a piston 63 and a piston rod 65. The piston 63 reciprocates through a cylinder 66, defined in the compressor body 60. Rotation of the piston rod 65 causes movement of the piston 63, and the crank or rod 65 is moved by a motor assembly 69.

Beneath the reciprocating compressor body 60 is the electric motor assembly 69 having a stator assembly 68, a rotor assembly 67 and an output shaft 64 which drives the piston rod 65 by way of a crank 59. The motor assembly 69 may also include a mount or frame-like portion for positioning the motor and/or connecting other structures. For example, the mount may be formed on or joined to the stator assembly 68. Either or both of the crank 59 and the output shaft 64 may pass through a collar to guide rotation. The motor assembly 69 and compressor components, together defining the compressor mechanicals, are all disposed in the housing 40 and sealed therein. The housing 40 may include fittings or other connectors which provide input and output through the housing 40 allowing refrigerant to flow into and out of the housing 40.

Disposed beneath the stator assembly 68 is a second damper 70, and according to some embodiments a second plurality of dampers. The dampers 70 limit movement of the motor assembly 69 and the connected reciprocating compressor body 60, relative to the lower housing portion 42. The dampers 70 provide damping between the motor assembly 69, and compressor components thereon, and the housing 40. The dampers 70 may also provide a second force on the compressor components. For example, the second force may be in a direction opposite the first direction or may be in some other direction differing from the first direction. According to some embodiments, the second plurality of dampers 70 may provide an upward force on the motor assembly 69 and/or compressor components whereas the spring 48 provides a downforce. Further, the dampers 70 limit lateral motion relative to the housing 40 as well as cushioning and/or clamping the motor assembly 69 and components. At the bottom of the dampers 70, are mount apertures 72 which extend through the dampers 70 to the upper apertures 74, which may be seen. These may be independent upper and lower apertures or may be a passage, for non-limiting example cylindrical, extending from top to the bottom of the dampers 70.

The motor, or motor assembly, 69 may have locating tabs 73 to engage and locate the dampers 70. Likewise, the lower housing portion 42 may also have locating tabs 75. The tabs 75 also engage and locate the dampers 70. In alternative embodiments, the dampers 70 may have tabs formed thereon which engage apertures or receiving structures formed in the motor assembly 69 or the housing portion 42.

The dampers 70 may be formed of various materials but may also be formed of a material having an 80 Durometer Shore A scale hardness in order to isolate some of the vibration and movement caused by the normal operation of the compressor, as well as limiting movement of these components relative to the upper and lower housing portions 41, 42. The dampers 70 may have at least a 70 Durometer Shore A scale.

When assembled, the first damper 48 and the second damper 70 are preloaded meaning they are at least partially compressed. By this preloading, the compressor components and motor or motor assembly 69 are limited in their movement within the housing 40. More specifically, vertical and lateral movement is limited and this contact with the housing 40 is also limited. The forces generally vector in opposed directions. The force vectors of the dampers 70 and the spring 48 may be aligned or may be offset from one another but in any event limit movement of the motor and compressor components within the housing 40. Further, the dampers 70 and spring 48 may apply forces sufficient to limit movement of the mass of the components within the housing to an acceptable range.

The stator assembly 68 and the lower housing portion 42 may include tabs 75 which engage or extend into the dampers 70 and specifically, the apertures 72, 74 formed therein. The locating features 73, 75 aid to maintain engagement between the stator assembly 68 and the dampers 70, as well as the lower housing portion 42 and the dampers 70. Beneath the lower housing portion 42 are a plurality of isolators 78 which isolate and damp the operation of the compressor 32 relative to the appliance 10 so that the operation sounds and vibrations are limited in transfer relative to the appliance 10. The isolators 78 may be located on at least one mount for the compressor 32.

Figure 4:
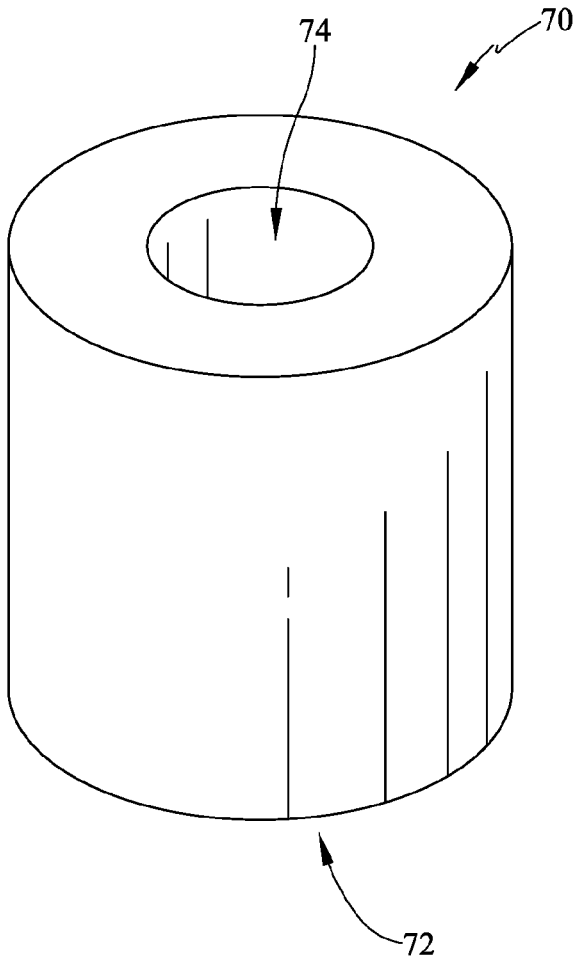
FIG. 4 is a perspective view of an example of a damper embodiment.

Referring now to FIG. 4, the damper 70 is depicted in perspective view. As previously indicated, the damper 70 may be formed of various materials. According to some embodiments, the material may be a urethane having an 80 Durometer Shore A scale hardness, however other hardness ratings may be used, for example having a hardness of at least 70 Durometer Shore A scale. Other rubber based materials may be used for non-limiting example.

The damper 70 limits vertical movement within the housing 40 and also limits movement in a lateral or horizontal direction. While the term "damper" is used, it is primarily utilized to differentiate a position, as opposed to the spring(s) 48. The damper 70 may be located below the compressor components and may also be defined by a spring structure or other damping structure. The damper 70 includes the upper aperture 74 and the lower aperture 72. As indicated, the opening may extend all the way through the damper 70 or may be two apertures therein. Each of these apertures 72, 74 receive a locating feature 73, 57 (FIG. 3), for example, on the stator assembly 68 (FIG. 3) and the lower housing portion 42 (FIG. 3) so that the dampers 70 are retained in position and the stator assembly 68 is maintained in appropriate position as well. In other embodiments, a male locating feature may be formed on the damper 70 and female features formed in the housing 40 and motor assembly 69.

Additionally, other materials may be utilized which provide support for the components above the damper 70, as well as to limit lateral movement of the components relative to the housing 40 (FIG. 3). For example, the dampers 70 may be formed of steel or wire springs, for example coil or conical for non-limiting example. The diameter of such wire springs may be of various diameter to various the force.

Further, it should be noted that while the damper 48 and damper 70 are shown as distinct structures, the first and second dampers may be connected. For example, the dampers 48, 70 may be interconnected either directly, or indirectly through two or more structures, in order to provide the damping between the housing 40 and the compressor components and/or the motor assembly 69. For example, some interconnections between the dampers 48, 70 may be a metal wire or metal wires, or alternatively may comprise a rubber or plastic connecting structure extending between the dampers 48, 70.

In some alternate embodiments, the lateral movement of motor assembly 69 and the compressor components may be limited to some extent by the first and second dampers 48, 70. In some embodiments, the lateral movement may be limited by addition of a further damper force. As shown in FIG. 3, force vectors $F_L$ represent a force in a lateral direction which may be provided by a damper which engages side of the housing 40 and placed a horizontal force on the compressor components or motor assembly 69. This may be in addition to lateral damping from the dampers 48, 70 or may be provided as the sole lateral damping for the compressor components and/or motor assembly 69. The damper providing such vector $F_L$ may be any of various types of the dampers and/or springs described herein but is not limited to these.

During start-up and stopping, it is common that the oscillation of the compressor mechanicals may be a larger amount than when functioning at normal operating speed. It is desirable that this damper 70 limits lateral movement so that the various components within the compressor housing 40 do not hit, contact or otherwise bang into the upper and lower housing portions 41, 42. However, in some embodiments, additional springs and/or dampers may be utilized to provide additional preloading and further limit lateral movement.

Figure 5:
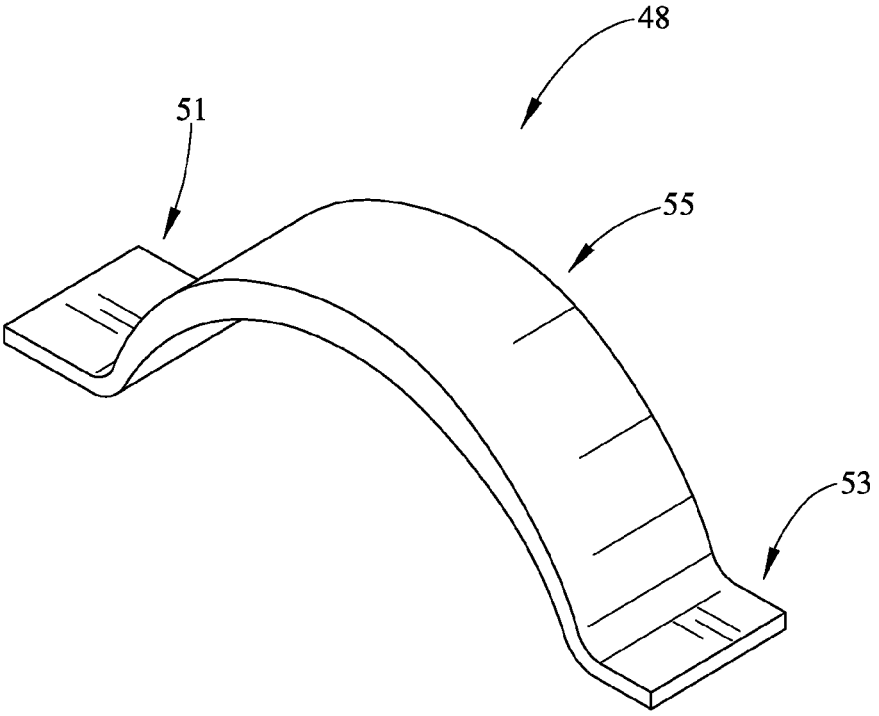
FIG. 5 is a perspective view of an example leaf spring embodiment.

Referring now to FIG. 5, a perspective view of the spring 48 is shown, in this example a leaf spring. This structure may be formed of various materials including metal or plastics which allow for a downforce to be applied from the upper housing portion 41 to the reciprocating compressor body 60 (FIG. 3). The engagement also preloads the dampers 70 and the spring 48. The spring 48 and the dampers 70 provide forces acting in different directions. In some embodiments, the force may be in parallel directions. In other embodiments, the direction may be in non-parallel directions. The spring 48 includes first and second grips or landings 51, 53 which are engaged by fasteners, retainers, mechanical joinders, or combinations thereof. The landings 51, 53 provide a location where the spring 48 may be retained but in other embodiments, the spring 48 may grasp some other part to retain its position. With brief reference to FIG. 3, a retainer 50 is shown with arms 52, 54 that engage the landings 51, 53 to retain the spring 48. The spring 48 also includes a rounded, upper surface 55 which extends between the landings 51, 53. The upper surface 55 may be of a constant thickness or may be of varying thickness in order to provide the desired amount of flex when the compressor 32 is starting up, shutting down, operating, or some other definable point of operation. It may be desirable to provide a continuous force on the compressor components beneath the spring 48 so that the spring 48 is always engaging the housing 40.

Figure 6:
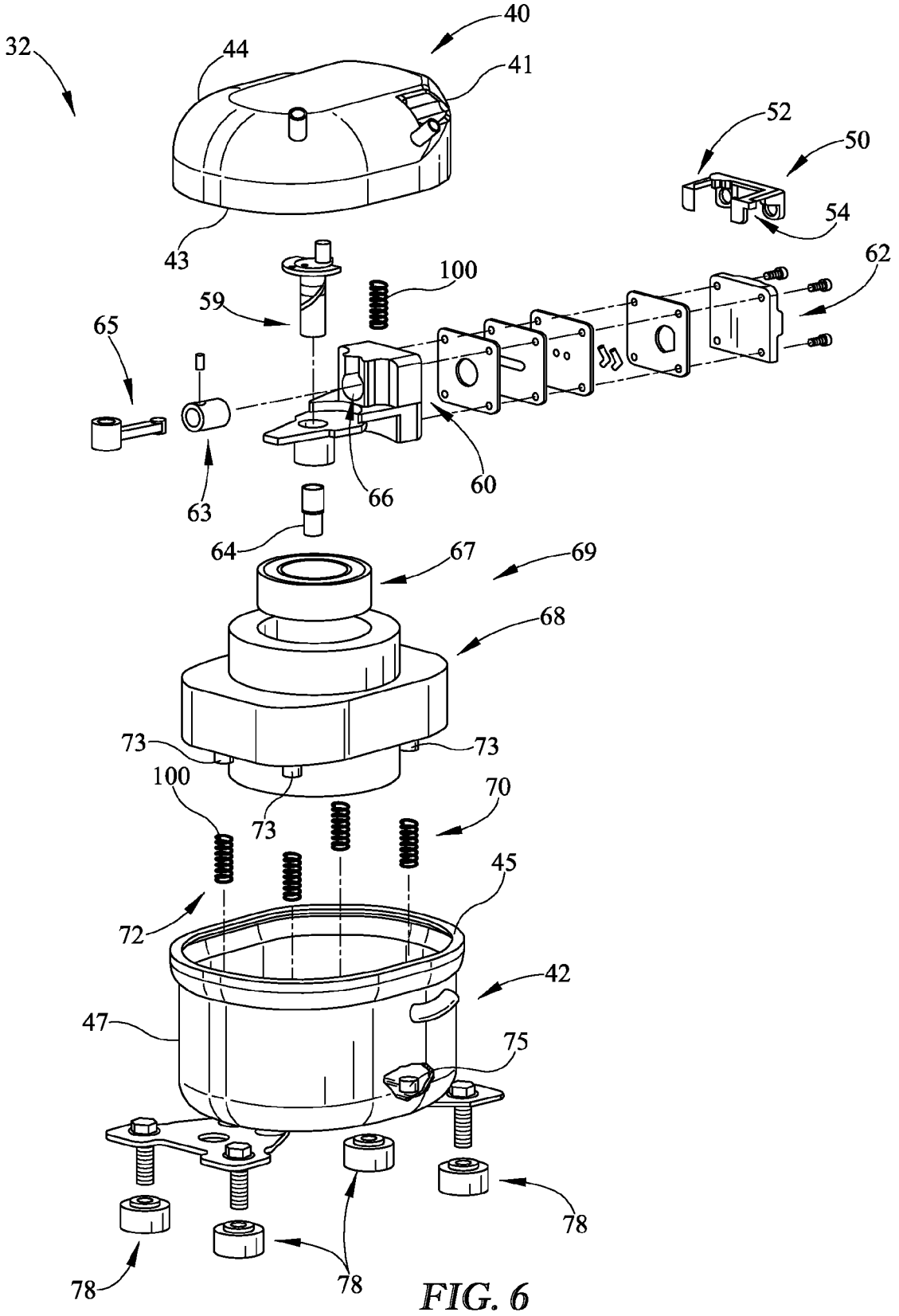
FIG. 6 is an exploded perspective view of the compressor with an alternate spring type.

Referring now to FIG. 6, a perspective view of an alternate damper is provided in the form of spring 100. The spring 100 may be a coil spring wherein the coil has a substantially constant wrap or coil diameter. The coil may be metallic or plastic and may have a wire diameter which is constant or may vary depending on the amount of force needed. The spring 100 may also be used as the second plurality of dampers 70 or may be used in place of the spring 48 (FIG. 3). Still further, the spring 100 may be used to provide lateral damping. As with the previous embodiments, the spring 100 force may be dependent upon the mass of the components of the compressor and the range of movement within the housing that is acceptable.

Figure 7:
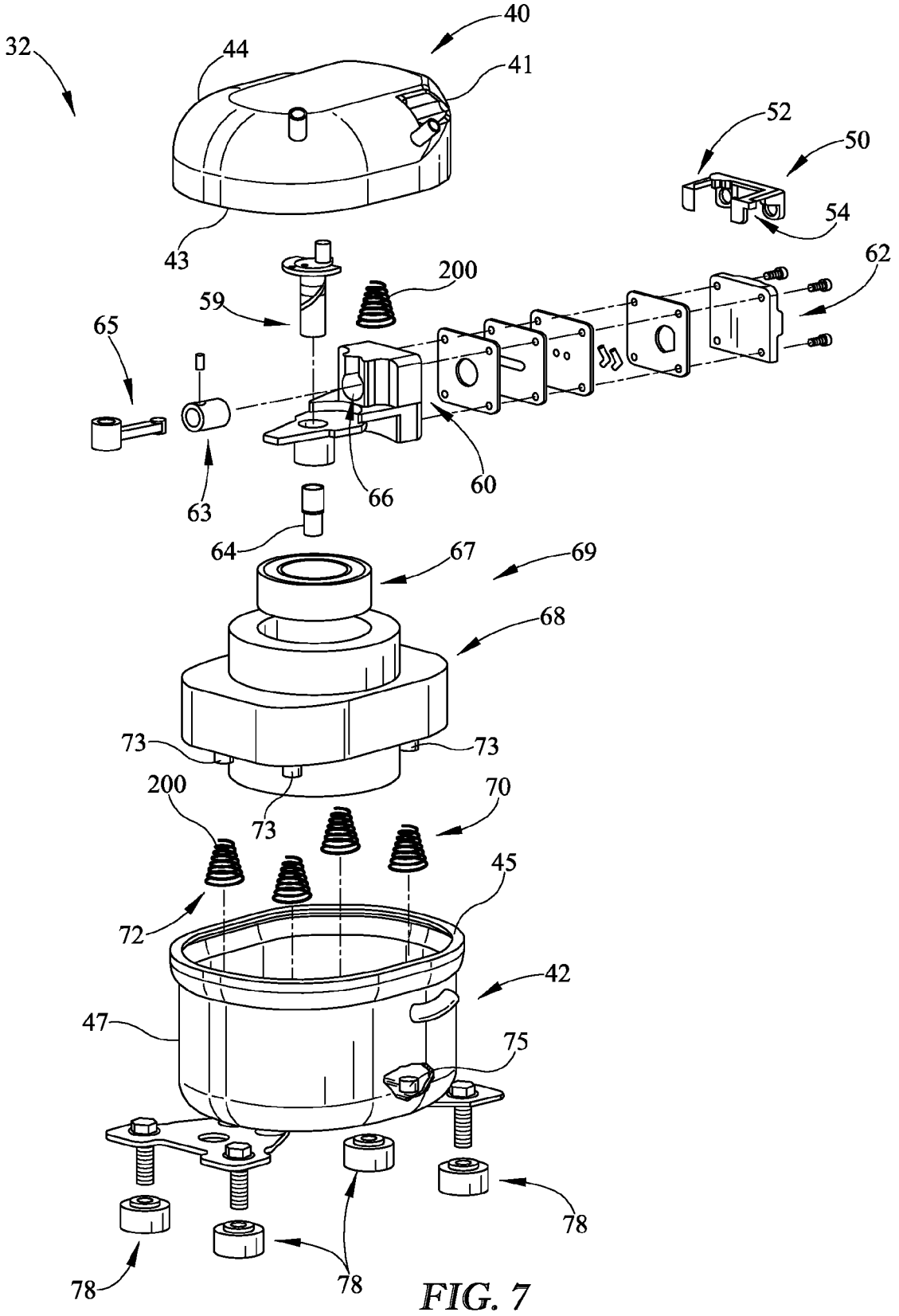
FIG. 7 is an exploded perspective view of the compressor with a further alternative spring type.

Referring now to FIG. 7, a perspective view of a further damper embodiment 200, wherein a spring is provided in the form of a conical spring or conical coil spring. The conical spring 200 is tapered from a larger diameter to a smaller diameter. The wire diameter may be constant or may vary. The spring 200 may be used at the location of the spring 48 (FIG. 3) or may be used at the location of the dampers 70 or may alternatively or additionally be used to provide lateral damping.

In order to operate the device, the dampers 70 are placed in the housing 40. Next, the compressor components and motor assembly 69 are positioned in the housing 40, for example lower housing portion 42 on the dampers 70. The spring 48 is positioned on an opposite side of the compressor components. The housing 40 and the compressor component are sealed closed. The compressor components and/or motor assembly 69 are then preloaded by nature of the size of the spring 48 and positioning within the housing 40 as well as the force created by the dampers 70 on the compressor components.

A retainer may, for example, clamp the spring 48 to an upper surface of the reciprocating compressor body 60 so that the spring 48 is kept in position and it may rub or otherwise act upon the upper housing portion 41 once the compressor 32 is fully assembled.

Further, whereas the forces or preloads are described as two, additional preloads may be provided to the components. For example, in addition to the preloading showed and described previously, springs and/or dampers may also be provided to provide additional preloads, for example in lateral directions. The additional lateral preloads may also be in opposite directions which are aligned or unaligned with each other. For example, the lateral preloads may be both on the motor or may both be on the compressor body or still further a force may be applied to each.

Figure 8:
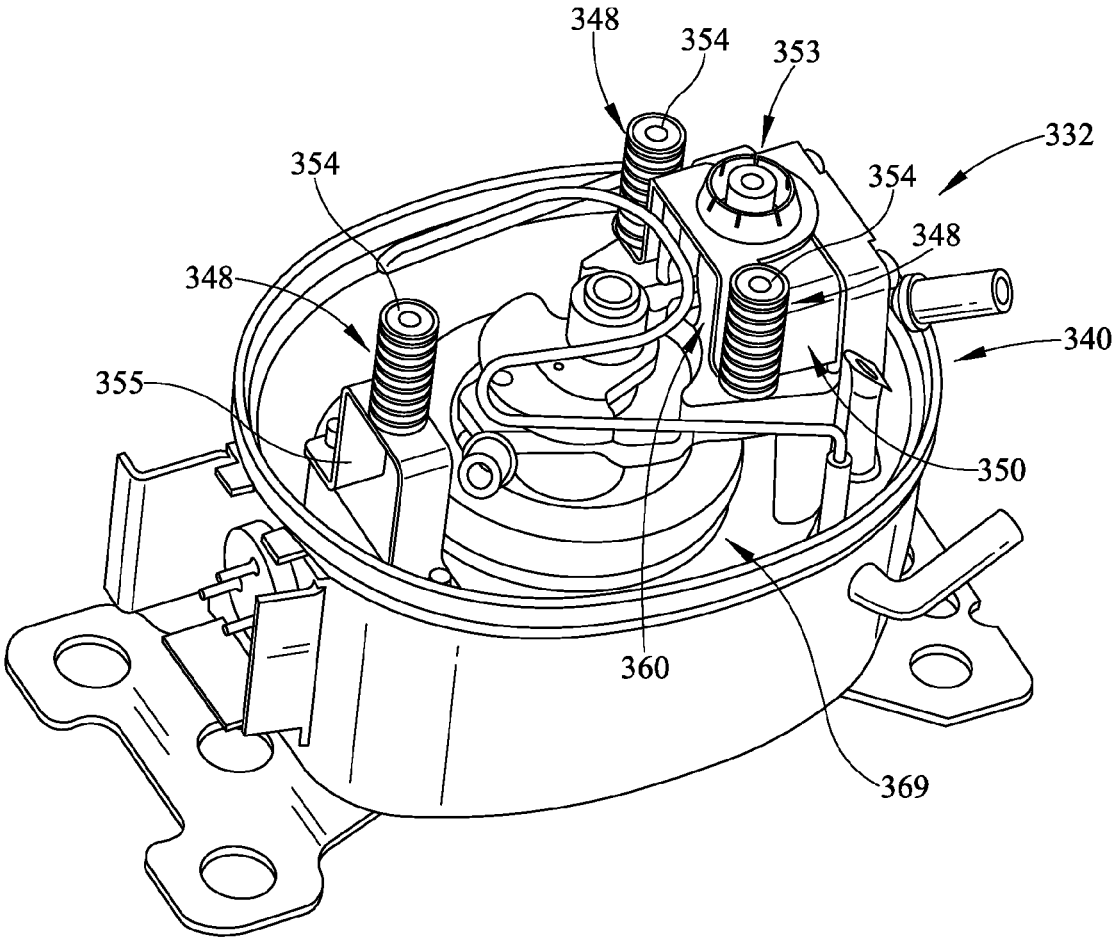
FIG. 8 is a perspective view of a further damped compressor.

Referring now to FIG. 8, a perspective view of a further embodiment of a compressor 332 is depicted in perspective view with an upper portion of the housing 340 removed. Within the housing 340 is the compressor motor assembly 369 and the plurality of compressor components including for example the compressor body 360. A housing or retainer 350 may extend over or around the compressor body 360.

The view depicts further embodiments of damper arrangements, including springs at preselected locations. The use of the terms of the term damper is inclusive of springs but may be other damping structures within the housing 340, as with previous embodiments. In the instant embodiment, a plurality of springs 348 are used at various locations to engage the upper portion (not shown) of the housing 340.

Each of the spring 348 includes a foot 352 which may be connected to, engage, or otherwise connected, directly or indirectly, to an internal portion of the compressor components or the motor assembly 369. In the depicted embodiment, two springs 348 are shown on the housing or retainer 350. The springs 348 extends from the foot 352 to the upper housing. At the upper end of the spring assembly is a cap 354. The cap 354 allows for engagement with a seat or other engagement structure on the interior surface of the upper housing. The cap and feet 354, 352 provide limiting effect on lateral movement of the springs 348 so that, in turn, lateral movement is also limited for the compressor components.

Additionally, at the left hand side of the figure, there is a damper embodied by spring 348 which is also mounted on a foot 352. The foot 352 is positioned on a bracket 355 extending from the motor assembly 369. This spring 348 also has a cap 354 which engages the upper housing. As with the other springs engaging the compressor components, this instant spring 348 and cap 354, foot 352 arrangement provides a down force as well as limits lateral movement of the motor assembly 369 and compressor components within the housing 340.

When these springs 348 are engaged by the upper portion of housing 340, the springs apply a force on the motor assembly 369 and/or compressor components. Further, the assemblies of the springs 348, caps 354 and feet 352 limit lateral movement within the housing 340.

Still further, on the upper surface of the housing 350, there is a cap assembly 353 which also engages an upper portion of the housing 340 to further stabilize and pre-load the compressor components. All of this decreases or eliminates spatial displacement of the motor assembly 369 and compressor components within the housing 340, in turn eliminating undesirable effects of vibration and impact shock between the housing and internal components.

Figure 9:
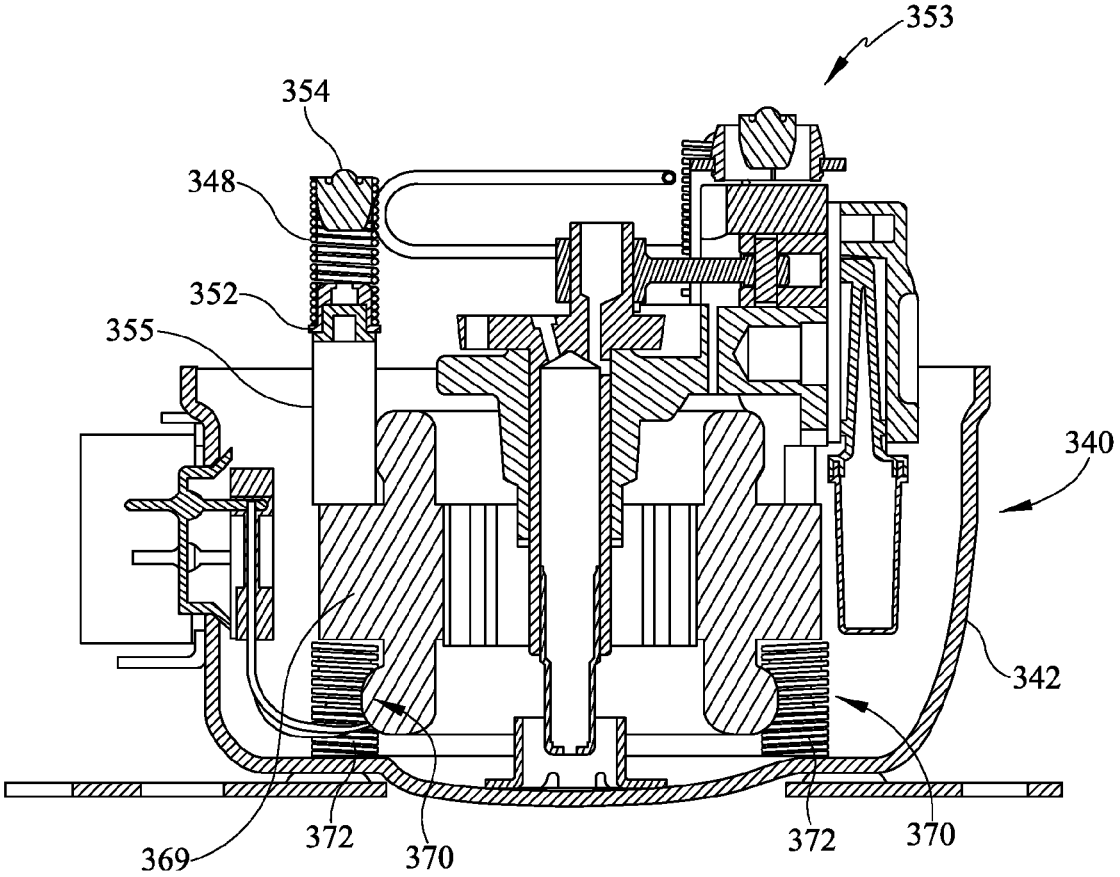
FIG. 9 is a section view of the damped compressor of FIG. 8.

Referring additionally to FIG. 9, a side section view of the compressor 332 is shown. In this view, the arrangement of the feet 352 and cap 354 is more clearly shown. Again, at the left hand side of the figure, there is shown a spring 348, a foot 352 and a cap 354. Also, shown is the bracket 355 upon which the foot 352 is positioned. The foot 352 may be formed integrally with the bracket 355 or may be fastened, or otherwise connected.

In this view, each of the caps 354 and feet 352 extend into the spring 348. This provides some stability in the lateral direction and inhibits the spring 348 from disengaging from the cap 354 and feet 352. Further still, in some embodiments, a damper structure may be used to extend upwardly through the spring or along the outside of the spring.

Also shown in the sectional view are dampers 370, which in the depicted embodiment are springs 372. The springs 372 may be connected to feet 75 (FIG. 7) and caps 73 (FIG. 7) or other structures to limit the springs 372 from disengaging from the lower portion of housing 340 and the motor assembly 369. Still further, a damper structure 70 (FIG. 4) may extend through or over the springs 372 to limit lateral movement.

With reference to both FIGS. 8 and 9, it may also be realized that since more than one damper may be utilized, the forces imparted by the dampers may all be different or may be the same. This may be dependent on the locations and the number of forces being applied from an upper position or a lower position. Further, it may be dependent upon the shape of the housing to determine where dampers can be located and limitations on the movement of the components or motor therein. Various other factors may be relevant to determining the damping force at each spring location and the number of dampers utilized. Further, while this is described relative to FIGS. 8 and 9, it should be clear to one skilled in the art, that such description of the forces and number of dampers may be applied to any of the embodiments herein.

Figure 10:
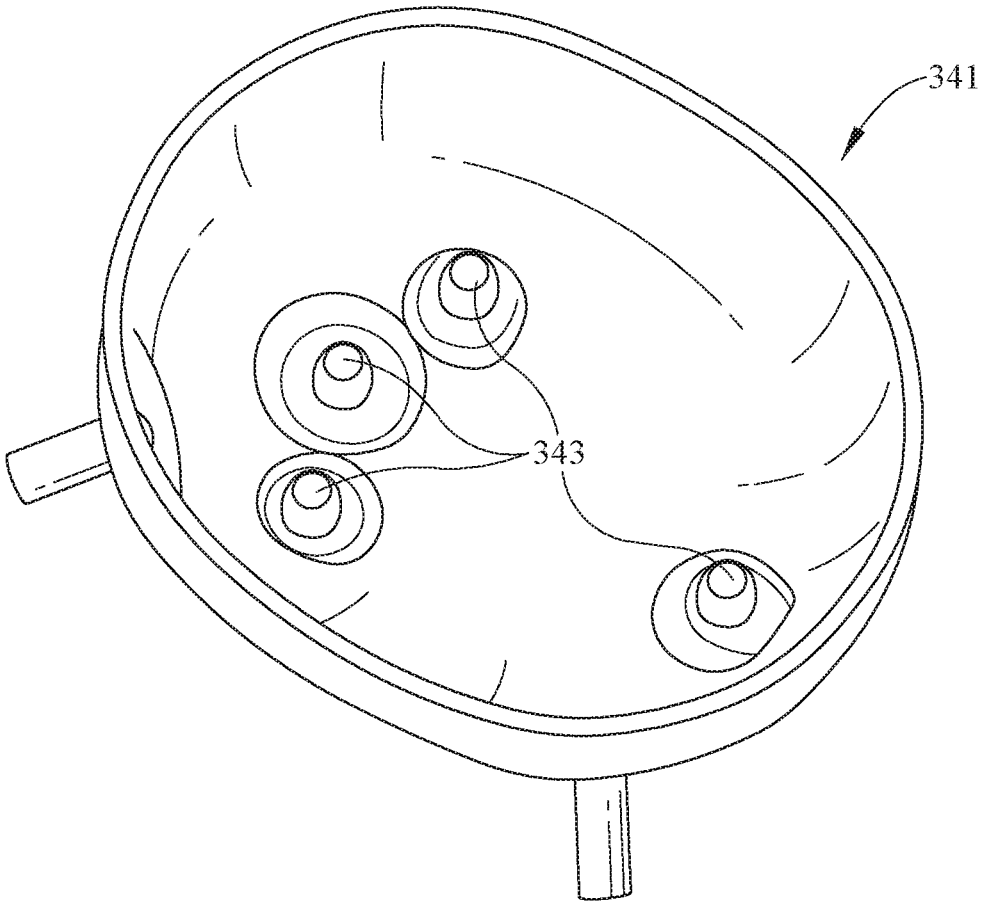
FIG. 10 is a perspective view of an upper inside compressor housing portion.

Referring briefly to FIG. 10, an inner perspective view is shown of an upper housing portion 341. The upper housing portion 341 has a plurality of locating landings 343. These landings 343 are located corresponding to positions shown for the caps 353, 354 (FIG. 8). As a result, these landings 343 provide an engagement structure located in position to engage the caps 353, 354 when the upper housing 341 is disposed on the lower housing 342 to define the housing 340. The landings 343 may be formed of various materials but in some embodiments may be a low or non-slip material which firm to add to the pre-loading of the springs 348 and dampers 370. Further, one skilled in the art will realize based on this disclosure that the landings 343 may be disposed at various locations and should not be limited to the positions depicted. Further still, while the depicted embodiment limits lateral movement, the lateral movement may also be limited in other manners, such as, for non-limiting example, those previously described.

Figure 11:
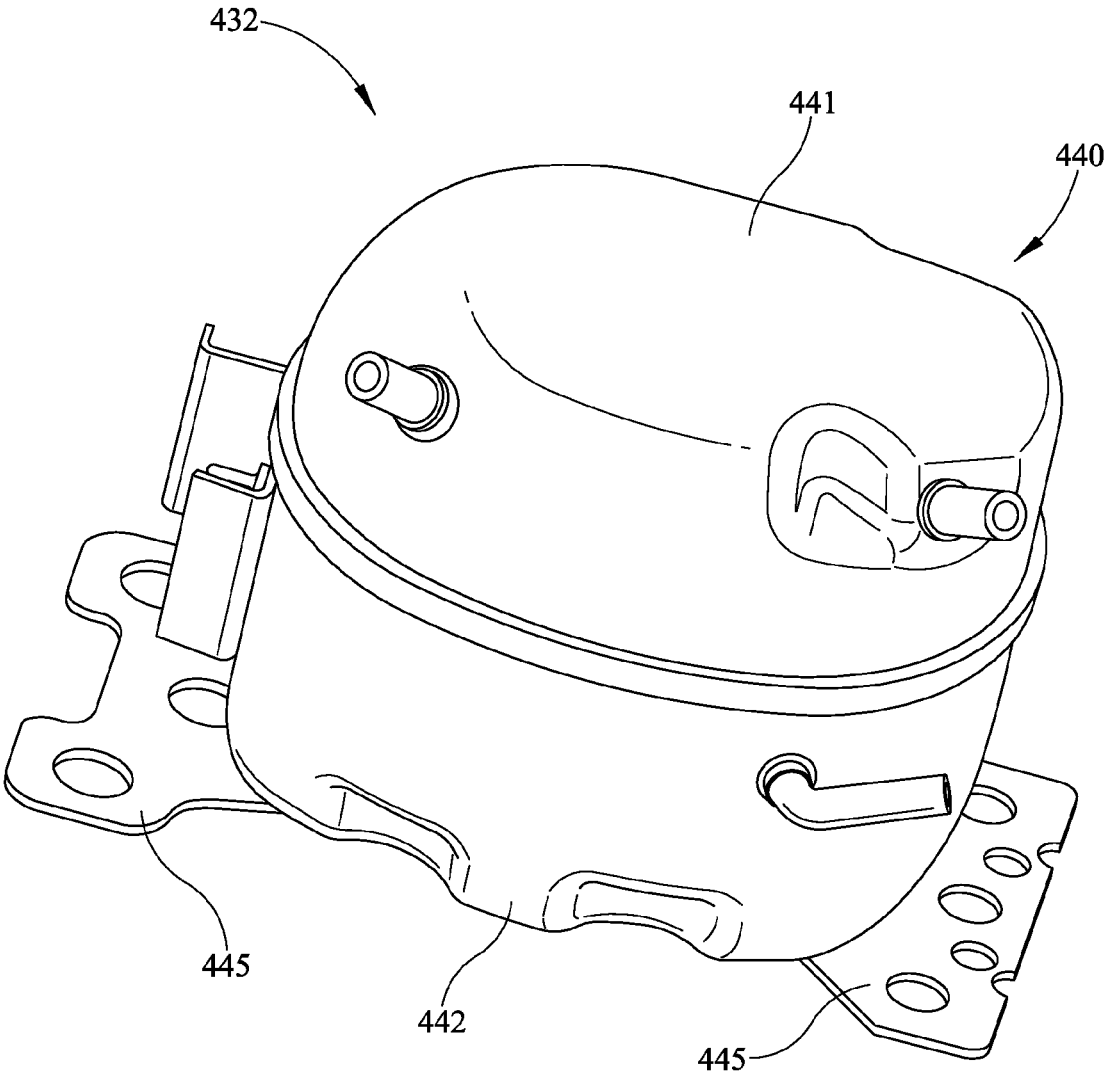
FIG. 11 is a perspective view of a further embodiment of a damped mobile compressor.

Referring now to FIG. 11, a further embodiment of a damped mobile compressor 432 is depicted. The compressor 432 comprises a housing 440 having a first portion 441 and a second portion 442. In the depicted embodiment, the first portion 441 corresponds to an upper housing and the second portion 442 corresponds to a lower housing. However, the housing 440 is not limited to an upper and a lower portion, but instead may also formed of two side portions that join along a joining line in the middle of the housing 440 or elsewhere. The depicted housing 440 embodiment may be desirable in order to inhibit leakage of refrigerant which is generally stored within at least the lower portion 442 and may extend into at least a portion of the upper portion 441 when the housing 440 is sealed closed.

The compressor 432 may also comprise one or more fluid inputs and/or outputs extending from the housing 440, defined by fittings or connectors. As shown in the Figure, two or more fluid conduits are shown extending from the housing 440. The conduits represent inlets and outlets for refrigerant into and out of the volume defined by the housing 440.

The compressor housing 440 may also include one or more mounts 445 to support the compressor 432 in position in the appliance or other device utilizing compressor services.

Figure 12:
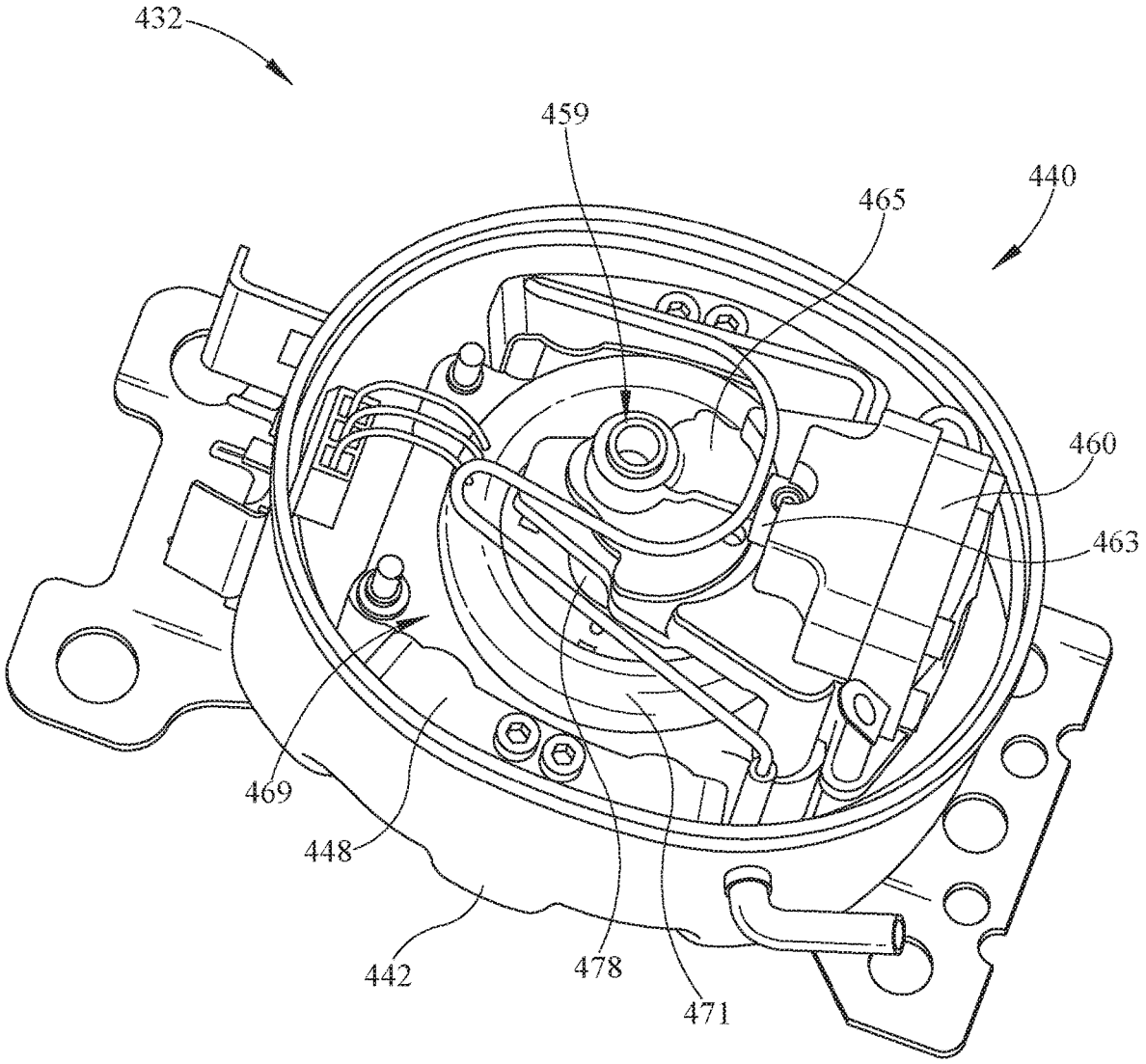
FIG. 12 is an upper perspective view of the embodiment of FIG. 11 with a portion of the housing removed.

With reference now to FIG. 12, an upper perspective view of the compressor 432 is shown with the upper housing portion 441 (FIG. 11) removed to reveal a plurality of compressor mechanicals therein. The compressor body 460 is shown positioned near the upper end of the mechanicals. A piston 463 is shown partially positioned within the compressor body 460 and a piston rod 465 is connected to the piston 463 for rotation by a crank 459. As the crank 459 rotates, the piston rod 465 is guided toward and away from the compressor body 460, in turn driving the piston 463 into and out of a cylinder 466 (FIG. 13) within the compressor body 460. A compressor cylinder is formed within the body 460 to receive the piston 463 during this movement. The compressor body 460 may be form of one or more parts and seals.

Beneath this assembly is a motor assembly 469 which may comprise a stator 471, a rotor 473, and a motor mount 478. As in previous embodiments, all of these components are generally referred to herein as the motor assembly 469 and for sake of clarity, the motor assembly 469, compressor body 460, piston 463, and piston rod 465 (compressor components) define at least a portion of the compressor mechanicals referred to in general. In operation, refrigerant is disposed within the compressor housing 440 and is drawn into the compressor body 460 and compressed by way of the piston 463 movement within the cylinder 466 therein. The compressed refrigerant is then forced out of the compressor body 460 and through other portions of the cooling mechanicals of the appliance or other device.

As previously referenced, the movement of the motor assembly 469, for non-limiting example during start-up and shut-down, may sometimes cause a knocking on the interior of the housing 440, resulting in undesirable noise, especially during period of time when a user of the appliance is trying to sleep. In order to reduce this noise, various damping features are provided in combination with the compressor mechanicals to reduce such noise.

As shown in the instant figure, a vertical retainer 448 is disposed within the housing to limit vertical movement of the compressor mechanicals within the housing 440. Additionally, lateral dampers 470 are provided within the housing 440 to limit movement and reduce the noise created during start-up, shutdown and other movements.

Figure 13:
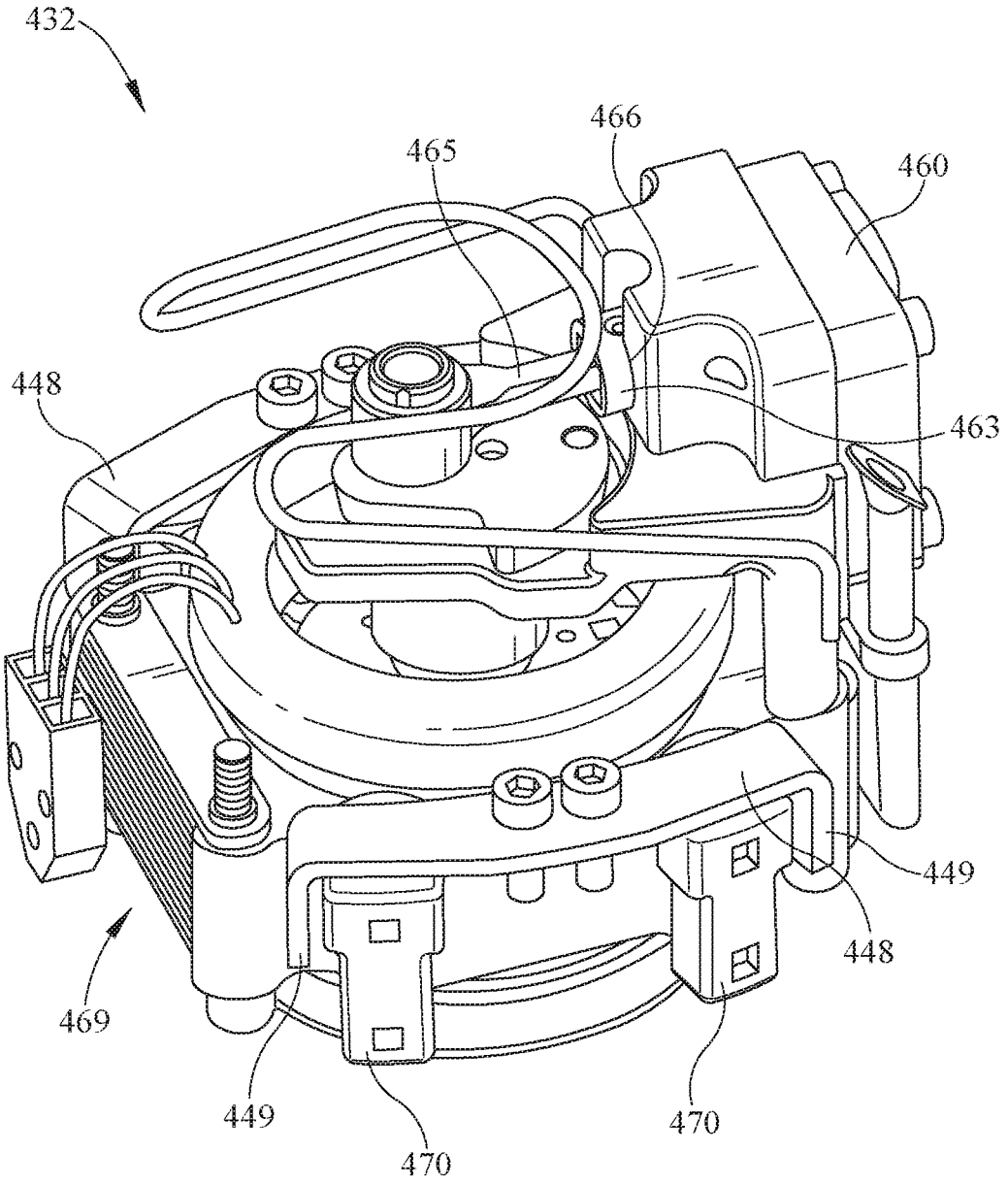
FIG. 13 is a perspective view of the compressor mechanicals shown removed from the housing.

Referring now to FIG. 13, various of the compressor mechanicals of the compressor 432 are removed from the housing 440 (FIG. 12) for ease of viewing the damping structures. The compressor body 460 is shown receiving the piston rod 465 and piston 463. The motor assembly 469 is engaged by at least one lateral damper 470 and the vertical retainer 448 on sides of the motor adjacent to the housing 440 (FIG. 12). The lateral dampers 470 may engage either of the motor assembly 469 or compressor body 460, as well as the internal surface of the housing 440. In the instant embodiment, the at least one lateral damper 470 is positioned on the motor assembly 469 and as the compressor mechanicals move within the housing 440, the lateral dampers 470 may engage an inner surface of the housing 440, and specifically the second portion 442 (FIG. 12) thereof.

In the instant embodiment, the at least one lateral damper 470 may be a first and second damper on each side of the motor assembly 469. Thus, there may be two dampers in some embodiments or four, as shown. Other numbers may be utilized. For example, if movement is limited so that only one location within the housing 440 is capable of being contacted, then a single lateral damper 470 may be utilized in that area. Alternatively, multiple dampers may be utilized in any of various locations where contact is possible and also where noise may be generated due to such contact.

The lateral dampers 470 may be formed of various materials. In some non-limiting examples, the lateral dampers are formed of a rubber material, such as hydrogenated nitril butadiene Rubber (HNBR). HNBR has desirable physical strength and retention of properties after long-term exposure to heat, oil, and chemicals. As one skilled in the art will understand, the dampers are exposed to refrigerant within the housing 440. HNBR may be used over a broad temperature range, −40° to 165° C., with minimal degradation over long periods of time. For low-temperature performance, low ACN grades should be used; high-temperature performance can be obtained by using highly saturated HNBR grades with white fillers. As a group, HNBR elastomers are resistant to common numerous fluids and industrial chemicals. However, other materials may be utilized which can operate in temperature extremes associated with refrigerants, and which are resistant to the chemicals utilized with refrigerants.

Additionally, positioned above the lateral dampers 470 are the vertical retainers 448. The vertical retainers 448 are shown in the instant embodiment as generally U-shaped and extending across the at least one lateral damper 470 on each side of the motor assembly 469. The vertical retainer 448 may engage a bracket 474 (FIG. 16) extending inwardly from the sidewall of the housing 440 and be fixed in position. Additionally, the lateral damper 470 may also engage a bracket or some other portion of the motor assembly 469. With the vertical retainer 448 fixed in position, the lateral dampers 470 have an upper bound to engage and thus limit movement in a vertical direction of the motor assembly 469, as well as the compressor body 460 and related components thereof.

As shown in the depicted view, the lateral dampers 470 may move to the right and left some amount for engaging legs 449 of the vertical retainer 448. Additionally, the lateral damper 470 may move upwardly before engaging a long segment of the vertical retainer 448 extending between the legs 449.

Figure 14:
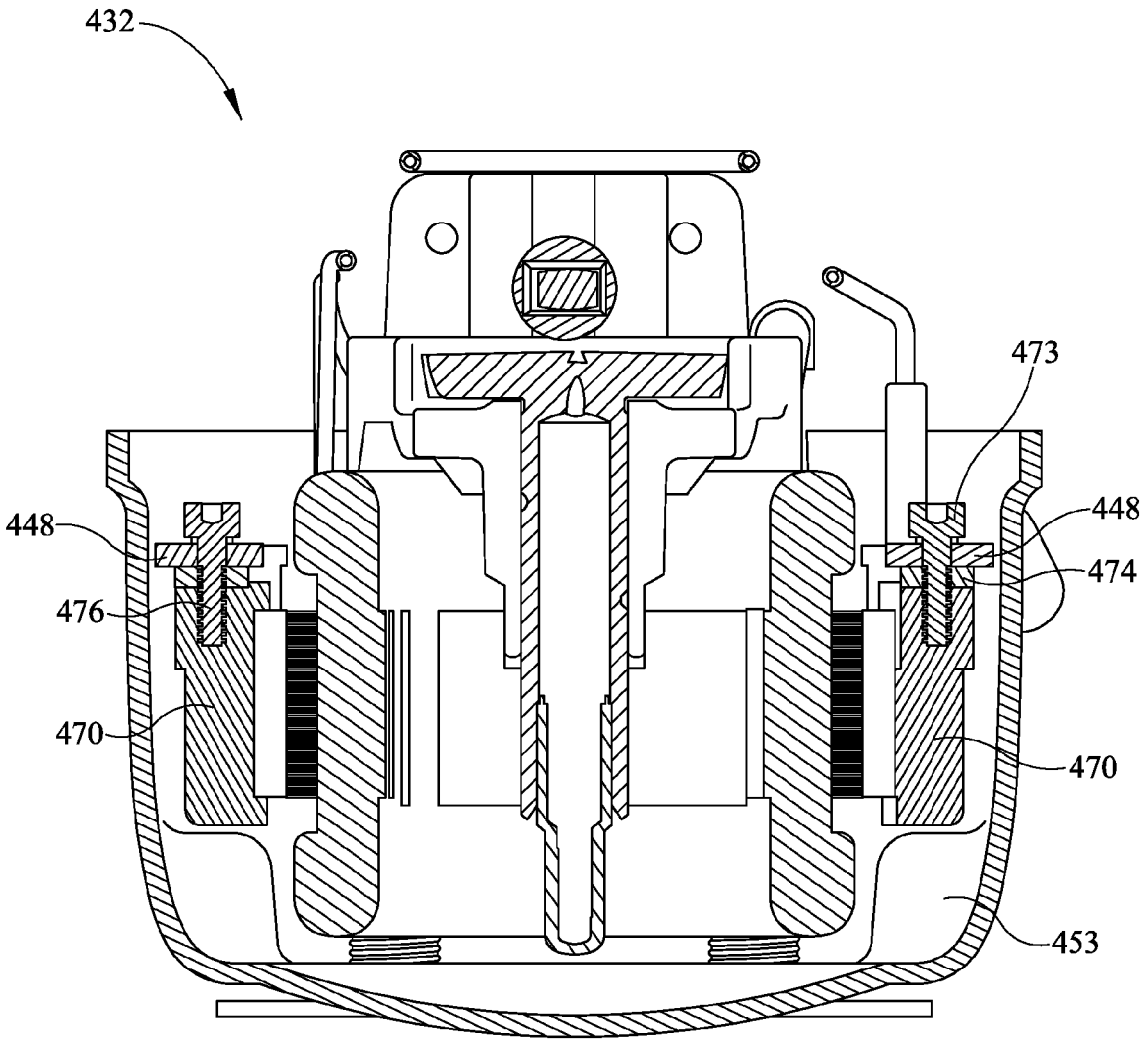
FIG. 14 is a section view of the compressor mechanicals and a housing portion shown in section view.

Referring now to FIG. 14, a section view of the housing 440 and compressor mechanicals is depicted to show arrangement of the vertical retainers 448 and dampers 470 therein. In this view, fasteners 476 are shown connecting the vertical retainer 448 to the bracket 474 extending inwardly from the inner surface of the housing 440. This view clearly shows the vertical retaining function in that the bracket 474 is fixed and therefore the retainer 448 cannot move upward, as well as the dampers 470 therebelow. While the lateral dampers 470 can move upward some amount, they reach an upper limit at the vertical retainer 448 thus stopping any further vertical movement of the assembly of compressor mechanicals.

Figure 15:
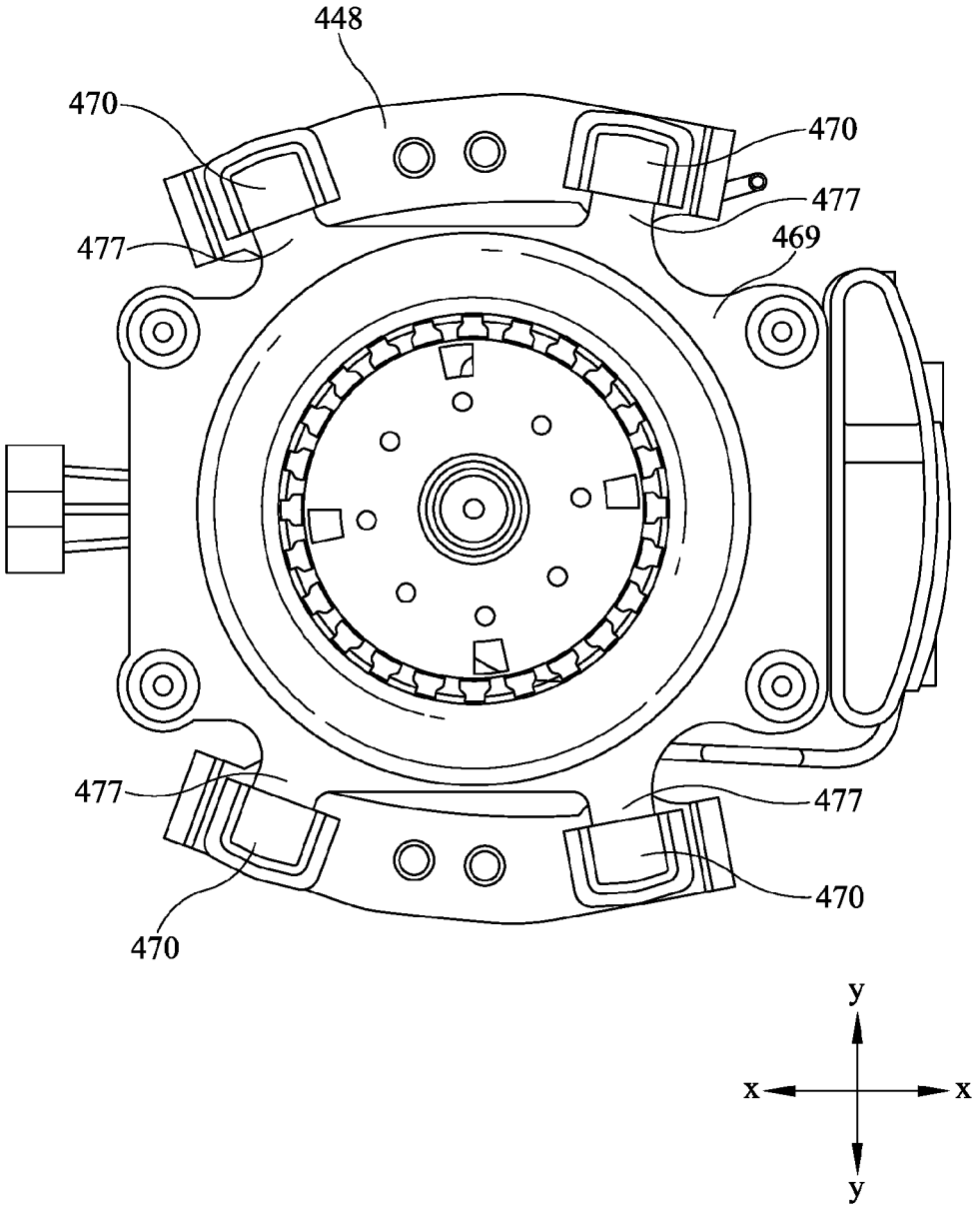
FIG. 15 is a bottom view of the compressor mechanicals shown removed from the housing.

With reference now to FIG. 15, a bottom view of the compressor mechanicals is shown along with the engagement limiting the lateral movement thereof. In the bottom view, the motor assembly 469 is shown with tabs 477 which engage the lateral dampers 470. This is merely one embodiment for engagement and as previously described, the lateral dampers 470 may be mounted to the housing 440 rather than the motor assembly 469, in alternative embodiments. In this view, it is clearer that with horizontal movement in the x direction, the lateral dampers 470 engage the ends of the vertical retainers 448. Further, with movement in the y direction, the lateral dampers 470 engage the inner surface of the housing 440 to limit movement. Finally, as previously described, vertical movement is limited by the vertical retainer 448.

Figure 16:
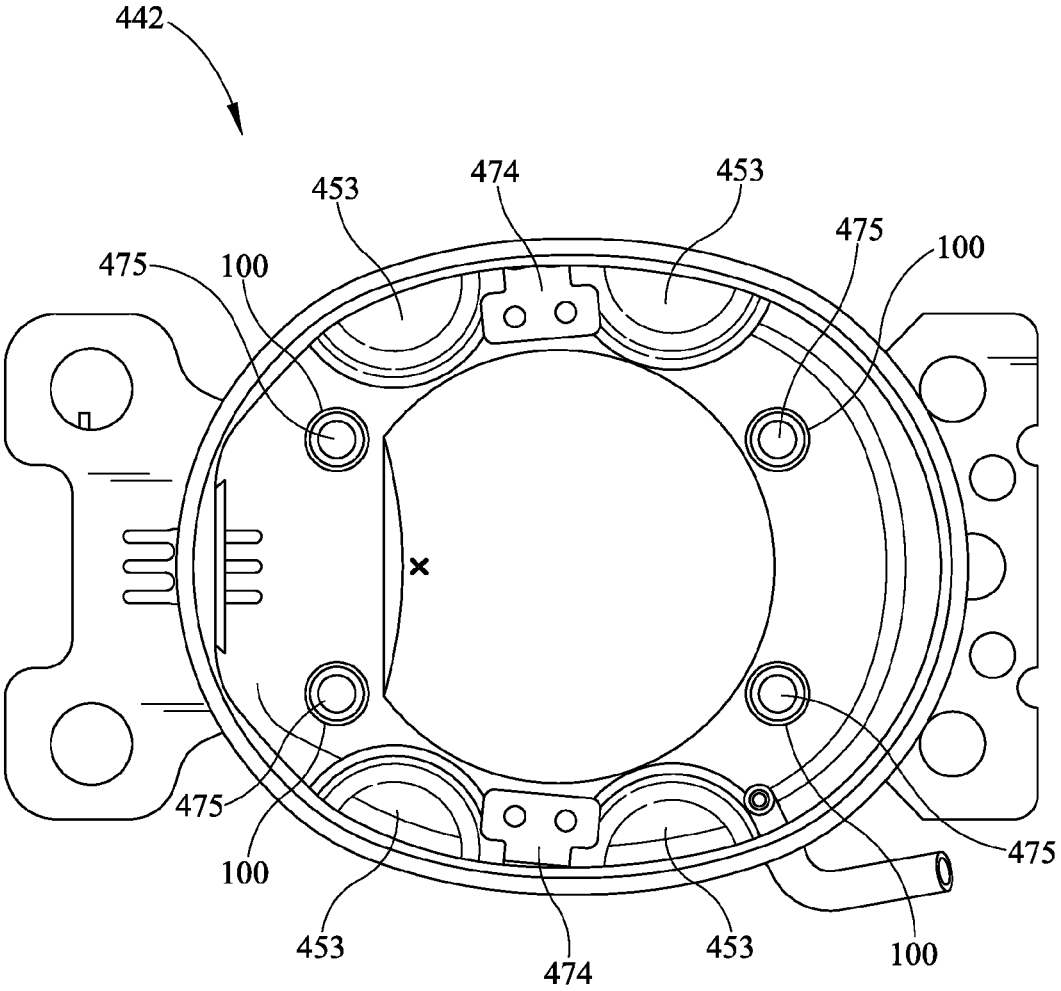
FIG. 16 is a top view of a portion of the housing with the compressor mechanicals removed therefrom.

Referring now to FIG. 16, a top view of the housing portion 442 is depicted. Within the interior of the housing portion 442 are lugs 453, or also may be referred to as a boss. The lugs 453 provide a bottom or lower limit for the lateral dampers 470 (FIG. 14). The lateral dampers 470 may be seated on the lugs 453 or may be slightly spaced therefrom to provide some clearance from initial movement up until a preselected amount at which time the dampers 470 will engage the lugs 453.

Also shown in this figure, are the brackets 474. These brackets 474 are located between the lugs 453 and along the inner wall of the housing portion 442. The brackets 474 may be L-shaped, generally, connecting to the housing 440 on one leg of the L and connecting to the vertical retainer along the other leg of the L-shape. This is one non-limiting example of a bracket and other shapes may be used.

In this embodiment, there are also shown a plurality of locating tabs 475 and springs 100. These springs 100 may be coiled springs or may be dampers of the type shown as damper 70, FIG. 3. This spring 100 or damper 70 provides an upward force on the bottom of the motor assembly 469 which is retained oppositely by the vertical retainer 448.

Figure 17:
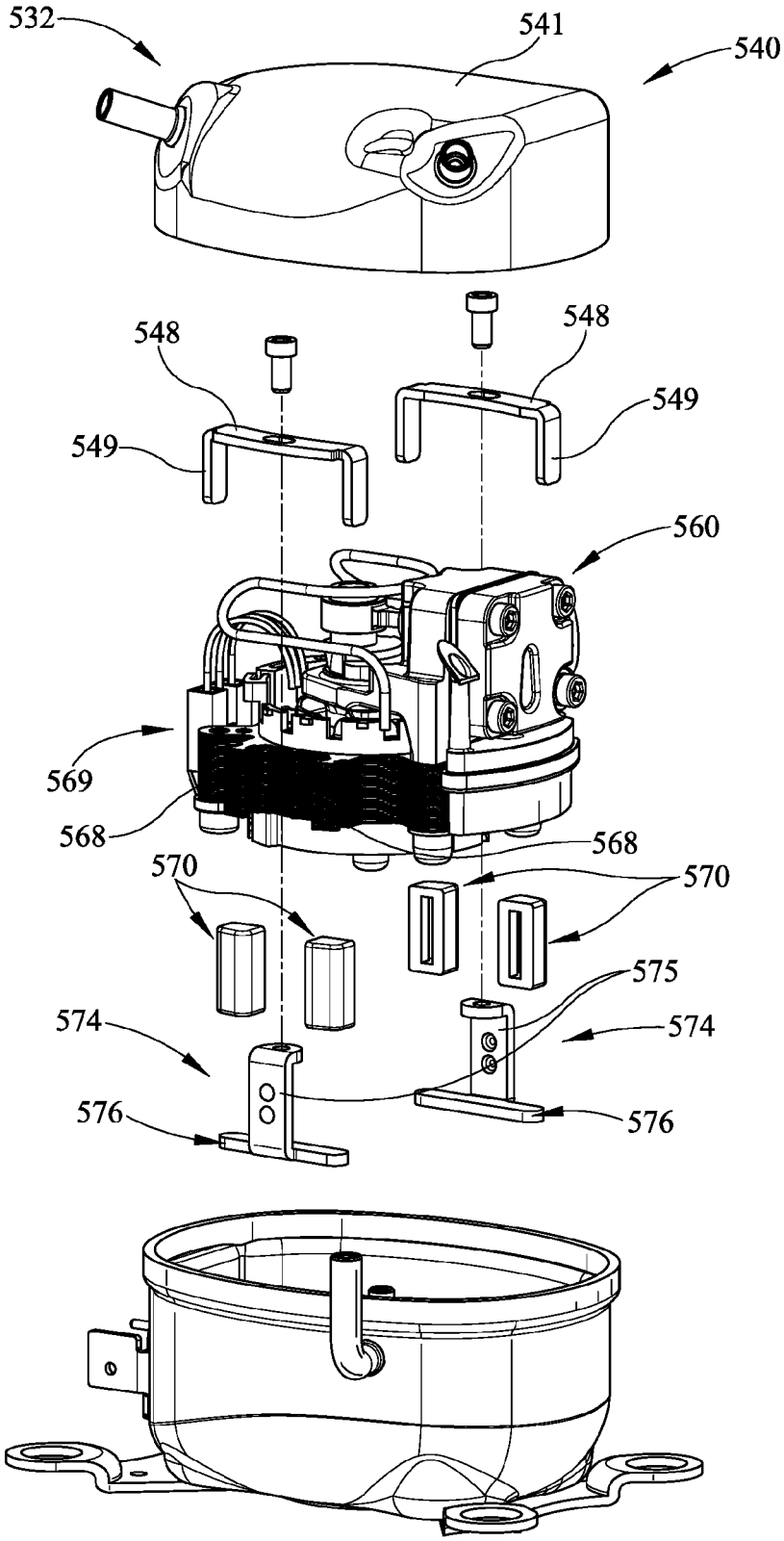
FIG. 17 is an exploded view of a further alternative embodiment of a damped mobile compressor.

Referring now to FIG. 17, an exploded perspective view of a further alternative damped mobile compressor 532. The housing 540 may comprise a first portion 541 and a second portion 542, depicted in split apart fashion but which are assembled to enclose the compressor body 560 and motor assembly 569 for normal operation. The housing 540 may be of various shapes and is not limited to the depicted embodiment.

Disposed above the compressor body 560 and motor assembly 569 are retainers 548. The retainers 548 may also comprise legs 549 to, for non-limiting example, define an L-shaped or U-shaped structure. Other shapes may be defined as well.

Extending from the motor assembly 569 are damper mounts 568. The damper mounts 568 are disposed about the periphery of the motor assembly, or may be about the compressor body 560, for positioning of lateral dampers 570. In some embodiments, the mounts 568 may have a head having a width wider than a neck that extends between the head and the motor assembly 569 and/or the compressor body 560.

Beneath the motor assembly 569 are the lateral dampers 570. The lateral dampers 570 are positioned on the damper mounts 568. The retainers 548 define an upper bound which is disposed above the lateral dampers 570. During operation of the compressor 532, the motor assembly 569 and the compressor body 560 move. The retainer 548 defines an upper bound for movement due to engagement of the lateral dampers 570 and retainers 548. Further, where the legs 549 are used with the retainers 548, the horizontal movement of the lateral dampers 570 may also be limited or bounded.

Beneath the retainers 548, are brackets 574. Each illustrative bracket 574 includes a vertical portion 575 and lower portion 576. The lower portion 576 of the bracket 574 defines a lower boundary for the lateral dampers 570, which may move with the motor assembly 569 and/or the compressor body 560.

The upper end of the vertical portion 575 may have a landing for positioning of the retainer 548. The retainer 548 is fastened to the brackets 574. During assembly, the motor assembly 569 may be disposed downwardly within the bounds of the brackets 574. Next the retainers 548 may be fastened or otherwise connected to the brackets 574 which captures the lateral dampers 570 between the retainers 548 and legs 549, as well as brackets 574, including the lower portion 576. In some embodiments, the structures defining the retainers 548 and brackets 574 may be formed together as a single structure.

Figure 18A:
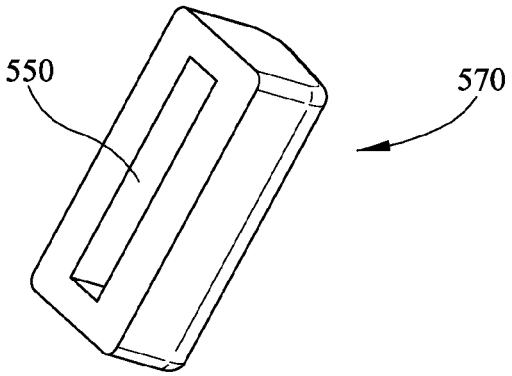
FIG. 18A-18C depict perspective views of the parts of the embodiment of FIG. 17.
Figure 18B:
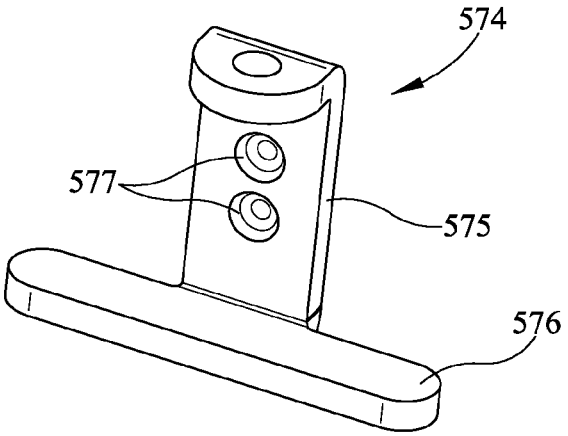
Figure 18C:
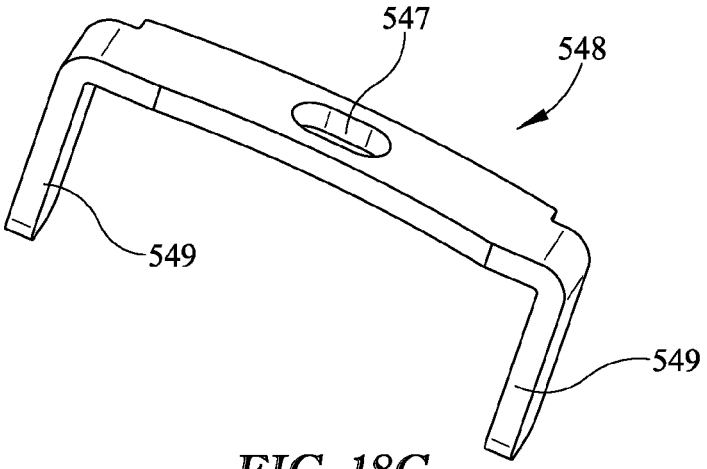

With reference to FIGS. 18A-18C, the lateral damper 570, retainer 548, and bracket 574 are shown in respective perspective views. First, with reference to FIG. 18A, the lateral damper 570 may be made of any of the materials previously described. The damper 570 may be provided with a rear surface having an opening 550 which receives the damper mount 568. The damper 570 may be formed of a material which has enough elasticity to change shape as it moves over the mounts 568 and may return to shape as a retaining portion of the mount 568 is within the opening 550. In other embodiments, the opening 550 may extend through one of the ends of the damper 570 so that the damper 570 may be slidably positioned on the damper mounts 568.

With reference to FIG. 18B, the bracket 574 is shown. The bracket 574 includes a vertical portion 575 and a lower or bottom portion 576. The vertical portion 575 may include an upper landing where the retainer 548 may be connected. Alternatively, the vertical portion may be connected to the retainer 548 in other ways and with other structures and shapes. Further, as shown in the figure, the vertical portion 575 may also include locating features 577 for positioning of the bracket 574 relative to the housing 540.

Referring to FIG. 18C, the retainer 548 is shown. The retainer 548 includes a fastening aperture 547 however other fastening structures may be used to provide either a permanent fastening or a removable connection. The ends of the retainer 548 may include legs 549 which depend from ends of the retainer 548. The legs 549 provide lateral limits for the dampers 570. Thus, as previously described, the assembly retainer 548 and bracket 574 capture and retain the dampers 570. The retainer 548 is positioned on the bracket 574 and may be connected by fastener as shown in FIG. 17, may be connected in other manners, and/or still further may be formed as a single structure.

Figure 19:
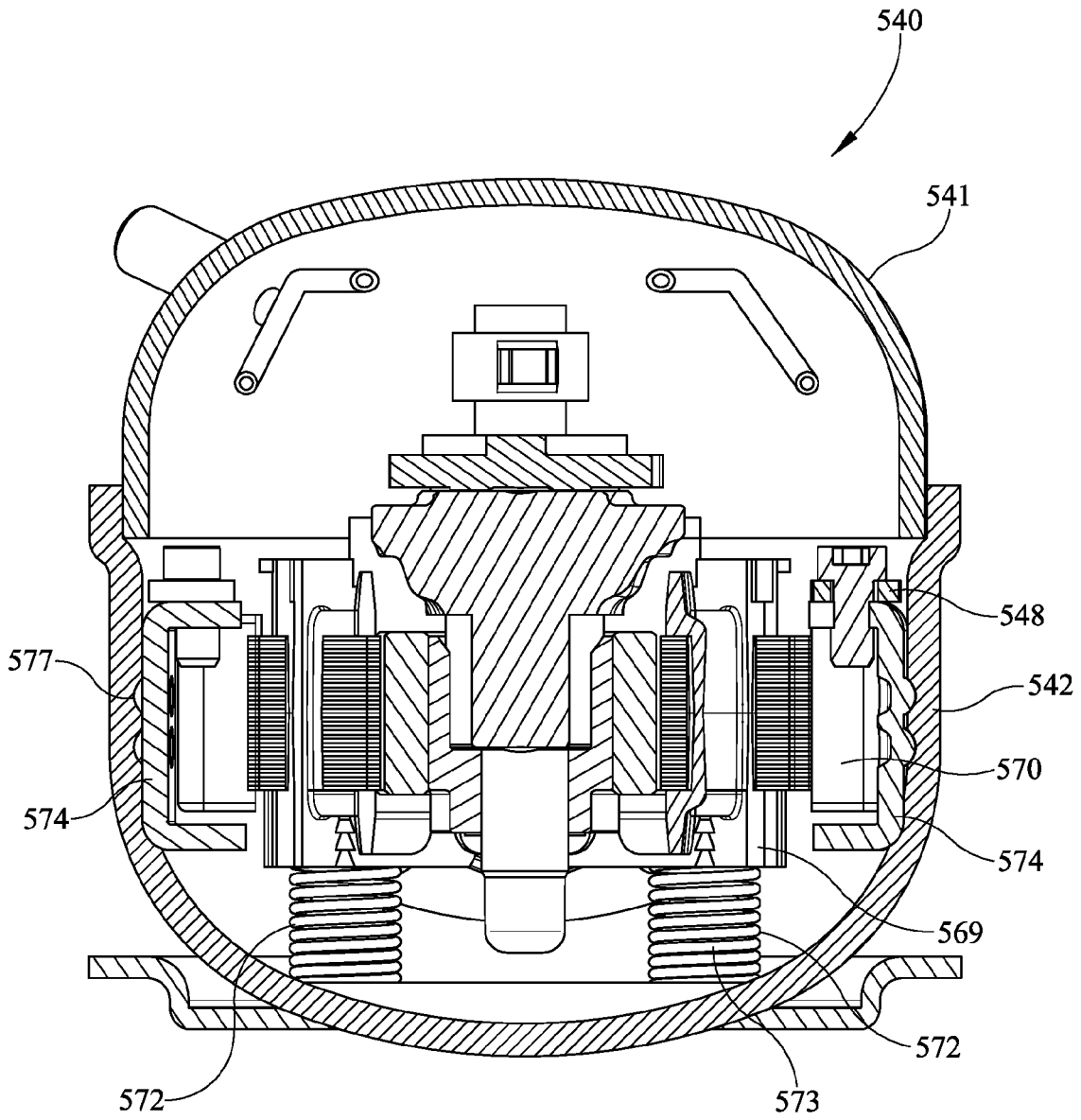
FIG. 19 is a side section view of the damped mobile compressor embodiment of 17; and, FIG. 20 is a top section view of the damped mobile compressor embodiment of FIG. 17.

With reference also to FIG. 19, a further section view is provided of the compressor 532. The compressor 532 is shown having springs or other damping structure beneath the motor assembly 569, for example springs 572 and locating features 573 within the interior of the springs 572. In this view, the retainer 548 and the bracket 574 are also shown assembled within the housing 540. As can be seen, the vertical dimension of the damper 570 is smaller than the dimension of the bracket 574. This is shown as a gap between the lower end of the damper 570 and the bracket 574. Accordingly, the lateral damper 570 may move with the motor assembly 569 and/or compressor body 560 between the upper bound of the bracket 574 and/or retainer 548 and the lower portion 576 of the bracket 574. Also as shown in the view, the bracket 574 may include the locating features 577 such as protuberances, ribs or the like male structure, which engages a female structure such as a dimple in the housing portion 542. Further, one skilled in the art should realize that the male/female relationship of features may be reversed.

Figure 20:
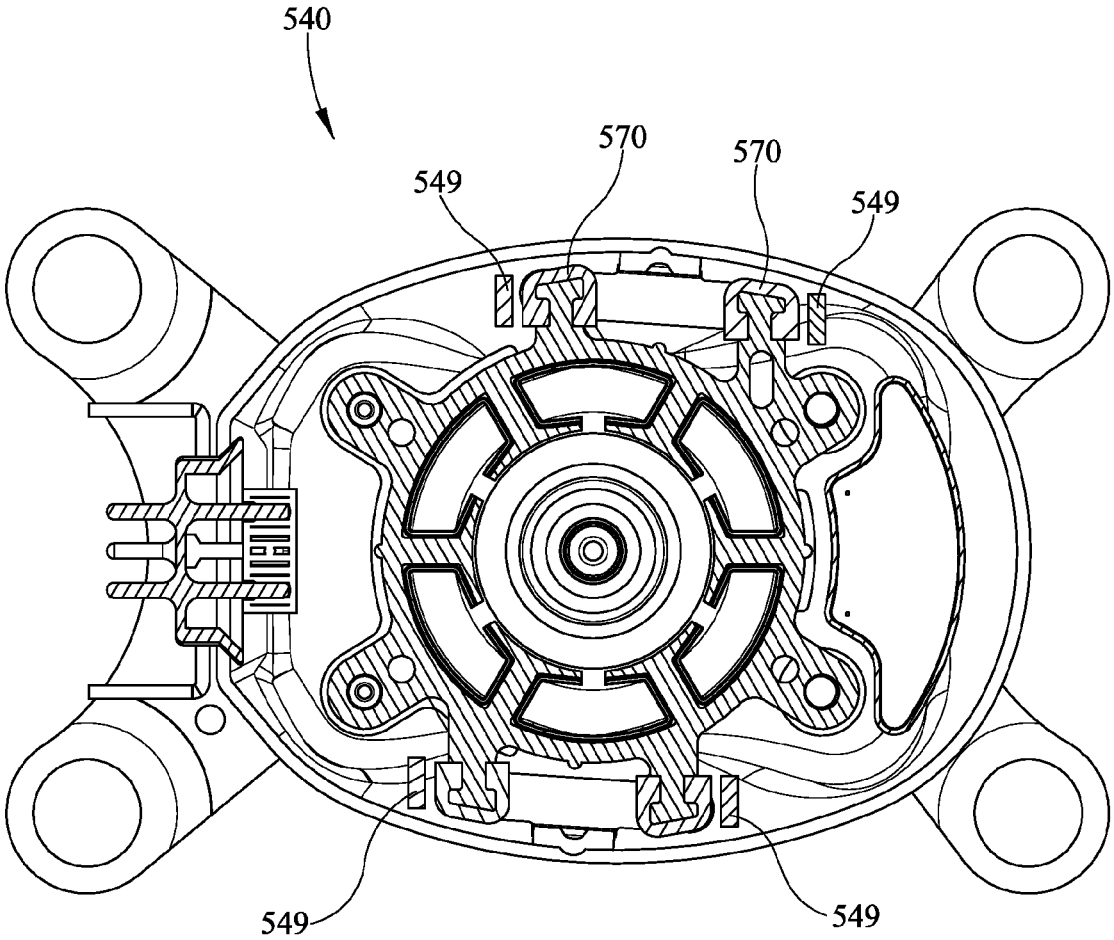

With reference now to FIG. 20, a section view of the compressor 532 is shown. In this view, the structure shows how the horizontal motion may be limited, as opposed to the vertical motion of FIG. 19. The Figures depicts the heads of the mounts 568 disposed in the lateral dampers 570.

Also, the figures depicts the relationship of the legs 549 relative to the lateral dampers 570. The legs 549 are shown adjacent to the dampers 570 to limit left and right directional movement of the motor assembly 569 and/or compressor body 560. Thus, considering the fully assembled structure, the lateral dampers 570 are restricted in multiple dimensions, limiting motion of the compressor body 560 and motor assembly 569 within the housing 540.

Also, one skilled in the art will realize that the dampers 570 may or may not be symmetrically positioned within the housing 540. As shown in the illustrative embodiment, the dampers 570 are not symmetrically disposed on opposite sides of a horizontal axis. This may be done for various reasons including, but not limited to, shape of the housing 540, fitting around other structures within the housing or the path of the movement of the assembly within the housing 540.

While the terms spring and damper have been used in this application, the examples of parts discussed related to each of those may be interchangeably used. For example various type of springs may be utilized for the spring 48 and likewise various types of springs may be utilized for the dampers and still considered dampers within the claims. Likewise, the dampers described in the specification may also be utilized at alternate locations and considered as a spring, or springs, for purpose of claim construction. The terms are merely used to differentiate location of the force being applied within the housing and provide ease of description. Still further where additional preloads are provided, for example in lateral directions, the lateral preloads may be termed springs or dampers and be formed of coil, conical, leaf or other springs, and/or the dampers shown and such terms are used interchangeably.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teaching(s) is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. A mobile refrigerant compressor, comprising:

a housing enclosing at least a motor and a compressor body;

a damper mount extending from one of said motor or said compressor body;

a first damper connected to said damper mount having an aperture to receive said damper mount;

a second damper connected to said damper mount having a second aperture to receive said damper mount;

a retainer disposed above said first damper and said second damper, and a bracket disposed below said first damper and said second damper, wherein said first and second dampers are captured between said retainer and said bracket, said retainer having a leg disposed at each lateral end of the retainer and each said leg capable of engagement with said first and second dampers to limit lateral movement;

a third damper engaging said housing and one of said motor or said compressor body, and, wherein said retainer limits upward vertical movement and lateral movement, and said bracket limits downward vertical movement, by engagement with said first and second dampers.

2. The mobile refrigerant compressor of claim 1, wherein said third damper is a spring.

3. The mobile refrigerant compressor of claim 2, wherein said spring is one of a leaf spring, a coil spring or a conical spring.

4. The mobile refrigerant compressor of claim 1, said first damper and said second damper limiting lateral movement of said motor and compressor body.

5. The mobile refrigerant compressor of claim 1, said third damper being preloaded when said mobile refrigerant compressor is assembled.

6. The mobile refrigerant compressor of claim 1, said second damper limiting motion in a direction opposite to said first damper.

7. The mobile refrigerant compressor of claim 1, said first and second dampers being a rubber-like elastomer.

8. A mobile refrigerant compressor, comprising:

a housing having a first portion and a second portion;

a motor and a compressor defining compressor mechanicals disposed within said housing;

a damper mount defined on said one of said compressor mechanicals;

a lateral damper positioned on said damper mount, said damper mount engaging one of said compressor mechanicals or said housing, said lateral damper limiting lateral movement of at least one of said compressor mechanicals relative to said housing, said lateral damper having an aperture which receives said damper mount;

a vertical retainer positioned above said lateral damper which limits vertical movement of said compressor mechanicals, said vertical retainer having legs disposed at ends and positioned laterally outward of said lateral damper;

a bracket vertical portion depending from said vertical retainer and a lower portion wherein said lateral damper is located between said vertical retainer and said lower portion.

9. The mobile refrigerant compressor of claim 8, said lateral damper being a first damper on a first side and a second damper on a second side of two sides of said housing.

10. The mobile refrigerant compressor of claim 9, said first damper being two dampers and said second damper being two dampers.

11. The mobile refrigerant compressor of claim 9 further comprising a bracket disposed on said housing.

12. The mobile refrigerant compressor of claim 11, said vertical retainer engaging said bracket.

13. The mobile refrigerant compressor of claim 12, said vertical retainer fastened to said bracket.

14. The mobile refrigerant compressor of claim 12, said vertical retainer engaging two dampers of said lateral damper on a first side of said two sides of said compressor.

15. The mobile refrigerant compressor of claim 14, further comprising a second vertical retainer engaging two dampers of said second damper on a second side of said two sides of said compressor.

16. The mobile refrigerant compressor of claim 8 further comprising a lug formed in said housing beneath said lateral damper.

17. A mobile refrigerant compressor, comprising:

a housing having a compressor and motor therein, said housing configured to receive a fluid refrigerant for compression by said compressor;

a first damper disposed on a damper mount, said first damper having an aperture which receives said damper mount, said damper mount connected to one of said motor or said compressor;

a retainer engaging said first damper and providing an upper bound for said first damper said first damper limiting vertical motion, and said retainer having a leg depending from each lateral end of said retainer which engages said first damper to limit lateral motion.

18. The mobile refrigerant compressor of claim 17, said retainer being substantially U-shaped.

19. The mobile refrigerant compressor of claim 18, said retainer also limiting movement of said motor and compressor in a horizontal direction.

20. The mobile refrigerant compressor of claim 17 further comprising a boss disposed in said housing beneath said first damper.

21. The mobile refrigerant compressor of claim 17, said first damper being two dampers spaced apart.

22. The mobile refrigerant compressor of claim 17, said motor and compressor seated on one of springs or dampers.

* * * * *